US011383509B2

(12) United States Patent
Efner et al.

(10) Patent No.: US 11,383,509 B2
(45) Date of Patent: Jul. 12, 2022

(54) METERING ROLLER FOR AN INK STATION ASSEMBLY OF A DECORATOR AND A METHOD OF DECORATING A CONTAINER WITH THE DECORATOR

(71) Applicant: BALL CORPORATION, Broomfield, CO (US)

(72) Inventors: John D. Efner, Broomfield, CO (US); Kurt J. Holland, Johnstown, CO (US)

(73) Assignee: BALL CORPORATION, Westminster, CO (US)

( * ) Notice: Subject to any disclaimer, the term of this patent is extended or adjusted under 35 U.S.C. 154(b) by 69 days.

(21) Appl. No.: 16/678,604

(22) Filed: Nov. 8, 2019

(65) Prior Publication Data

US 2020/0147954 A1 May 14, 2020

Related U.S. Application Data

(60) Provisional application No. 62/758,063, filed on Nov. 9, 2018.

(51) Int. Cl.
*B41F 31/02* (2006.01)
*B41F 17/00* (2006.01)

(52) U.S. Cl.
CPC ..... *B41F 31/022* (2013.01); *B41F 17/006* (2013.01)

(58) Field of Classification Search
CPC ..... B41F 13/34; B41F 13/40; B41F 31/30; B41F 31/32; B41F 31/34; B41F 31/36;
(Continued)

(56) References Cited

U.S. PATENT DOCUMENTS 2,326,850 A 8/1943 Gladfelter et al.
2,753,795 A 7/1956 Bruns
(Continued)

FOREIGN PATENT DOCUMENTS

DE 3209740 12/1982
EP 0088129 9/1983
(Continued)

OTHER PUBLICATIONS

"Concord 36MRT Decorator Operating and Maintenance Manual," Stolle Machinery Company, Sep. 2005, 118 pages.
(Continued)

*Primary Examiner* — Leslie J Evanisko
*Assistant Examiner* — Leo T Hinze
(74) *Attorney, Agent, or Firm* — Sheridan Ross P.C.

(57) ABSTRACT

An apparatus and methods of decorating exterior surfaces of metallic containers are provided. More specifically, the present disclosure provides a novel metering roller for an inking assembly of a decorator. An adjustment mechanism is operable to move the metering roller to a first ink transfer position during a decoration run. In the first ink transfer position, the metering roller receives ink from an ink roller without contacting the ink roller. In one embodiment, during the production run, the metering roller is in contact with and transfers ink to a transfer roller. When the decoration run stops, the adjustment mechanism can move the metering roller to a second dwell position such that the metering roller does not receive ink from the ink roller.

18 Claims, 7 Drawing Sheets

(58) Field of Classification Search
CPC ..... B41F 31/38; B41F 31/022; B41F 17/006; B41F 17/22
See application file for complete search history.

(56) References Cited

U.S. PATENT DOCUMENTS

| | | | |
|---|---|---|---|
| 3,223,028 | A | 12/1965 | Brigham |
| 3,229,631 | A | 1/1966 | Peterson |
| 3,601,049 | A | 8/1971 | Hamilton |
| 3,603,254 | A | 9/1971 | Siebke |
| 3,786,747 | A | 1/1974 | Szpitalak |
| 3,960,073 | A | 6/1976 | Rush |
| 4,223,603 | A | 9/1980 | Faddis et al. |
| 4,337,699 | A | 7/1982 | Beisel |
| 4,384,518 | A | 5/1983 | Albin |
| 4,432,282 | A | 2/1984 | Jurinak |
| 4,445,433 | A | 5/1984 | Navi |
| 4,455,934 | A | 6/1984 | Van Der Roer |
| 4,538,518 | A | 9/1985 | Dahlgren |
| 4,546,701 | A | 10/1985 | Junghans |
| 4,721,266 | A | 1/1988 | Haapanen et al. |
| 4,741,266 | A | 5/1988 | Stirbis et al. |
| 4,921,093 | A | 5/1990 | Peters et al. |
| 5,005,476 | A | 4/1991 | Kobler et al. |
| 5,111,742 | A | 5/1992 | DiDonato et al. |
| 5,119,726 | A | 6/1992 | Doersam |
| 5,148,742 | A | 9/1992 | Stirbis et al. |
| 5,183,145 | A | 2/1993 | Williams et al. |
| 5,186,100 | A | 2/1993 | Turturro et al. |
| 5,231,926 | A | 8/1993 | Williams et al. |
| 5,233,922 | A | 8/1993 | Stirbis et al. |
| 5,337,659 | A | 8/1994 | Whelan |
| 5,351,614 | A | 10/1994 | Depa |
| 5,363,763 | A | 11/1994 | Fiore |
| 5,372,067 | A | 12/1994 | Doyle |
| 5,429,050 | A | 7/1995 | Palmcrantz |
| 5,553,541 | A | 9/1996 | Vrotacoe et al. |
| 5,572,927 | A | 11/1996 | Sirvet |
| 5,609,100 | A | 3/1997 | Williams |
| 5,799,574 | A | 9/1998 | Williams et al. |
| 5,908,505 | A | 6/1999 | Bargenquest et al. |
| 6,167,805 | B1 | 1/2001 | Williams et al. |
| 6,178,886 | B1 | 1/2001 | Williams et al. |
| 6,467,609 | B1 | 10/2002 | Williams et al. |
| 6,550,389 | B1 | 4/2003 | Goto et al. |
| 6,578,481 | B1 | 6/2003 | Beisel et al. |
| 6,651,552 | B1 | 11/2003 | Didonato |
| 6,672,211 | B2 | 1/2004 | Price et al. |
| 6,899,998 | B2 | 5/2005 | Figov |
| 7,150,226 | B2 * | 12/2006 | Hirt ..... B41F 7/40 101/352.01 |
| 8,001,894 | B2 | 8/2011 | Rauh |
| 8,069,785 | B2 | 12/2011 | Schafer et al. |
| 8,850,976 | B2 | 10/2014 | Jeter |
| 9,475,276 | B2 | 10/2016 | Fleischer et al. |
| 9,862,204 | B2 | 1/2018 | Izume |
| 9,884,478 | B2 | 2/2018 | Fleischer et al. |
| 2002/0096066 | A1 | 7/2002 | Callahan et al. |
| 2005/0045053 | A1 | 3/2005 | Finan |
| 2012/0216689 | A1 | 8/2012 | Cochran et al. |
| 2012/0272846 | A1 | 11/2012 | Fleischer et al. |
| 2013/0174753 | A1 | 7/2013 | Jeter |
| 2014/0360394 | A1 | 12/2014 | Carreras |
| 2014/0373741 | A1 | 12/2014 | Wilkinson |
| 2015/0128819 | A1 | 5/2015 | Vella |
| 2015/0128821 | A1 | 5/2015 | Vella |
| 2015/0183211 | A1 | 7/2015 | Petti et al. |
| 2015/0217559 | A1 | 8/2015 | Carreras et al. |
| 2016/0229198 | A1 | 8/2016 | Izume |
| 2017/0008270 | A1 | 1/2017 | Fleischer et al. |
| 2018/0024076 | A1 | 1/2018 | Efner et al. |
| 2018/0126724 | A1 | 5/2018 | Fleischer et al. |
| 2018/0201011 | A1 | 7/2018 | Efner |
| 2019/0257692 | A1 | 8/2019 | Cochran |

FOREIGN PATENT DOCUMENTS

| | | |
|---|---|---|
| EP | 0263422 | 4/1988 |
| EP | 0583667 | 2/1994 |
| EP | 1262321 | 12/2002 |
| JP | H08-238756 | 9/1996 |
| JP | 2002-225233 | 8/2002 |
| JP | 2011-62964 | 3/2011 |
| WO | WO 94/19192 | 9/1994 |
| WO | WO 2008/099330 | 8/2008 |
| WO | WO 2013/113616 | 8/2013 |
| WO | WO 2014/006517 | 1/2014 |
| WO | WO 2014/008544 | 1/2014 |
| WO | WO 2014/108489 | 7/2014 |
| WO | WO 2014/128200 | 8/2014 |

OTHER PUBLICATIONS

International Search Report and Written Opinion for International (PCT) Patent Application No. PCT/US19/60450, dated Jan. 30, 2020 10 pages.

* cited by examiner

METERING ROLLER FOR AN INK STATION ASSEMBLY OF A DECORATOR AND A METHOD OF DECORATING A CONTAINER WITH THE DECORATOR

CROSS-REFERENCE TO RELATED APPLICATIONS

This application claims priority under 35 U.S.C. § 119(e) to U.S. Provisional Patent Application Ser. No. 62/758,063 filed Nov. 9, 2018, which is incorporated herein in its entirety by reference.

FIELD

The present disclosure relates generally to decorators and methods of decorating exterior surfaces of metallic containers used in the food and beverage packaging industries. More specifically, the present disclosure provides a novel metering roller for an ink station assembly of a decorator.

BACKGROUND

Metallic containers provide many benefits compared to containers made of glass or plastic. Many consumers and distributors prefer metallic containers due to the convenience they offer and their light weight. The surfaces of metallic containers are also ideal for decorating with brand names, logos, designs, product information, and other preferred indicia for identification, marketing, and distinguishing brands between competitors. Because of these and other benefits, hundreds of billions of metallic containers are produced globally each year.

To meet the global demand for metallic containers, equipment in a metallic container manufacturing line, including decorators, must operate at very high speeds. In some manufacturing lines, decorators can decorate 500 or more metallic containers per minute. Because of the high speeds of container production lines, techniques or processes that may work in other industries or with containers formed of other materials do not necessarily work at the high speeds required for metallic container production lines. For example, apparatus and methods of decorating sheets or webs of paper and cardboard materials are distinct from decorators used for 3-dimensional objects, such as metallic containers. Further, inks formulated to adhere to metallic containers have different properties than inks used to print on paper or plastics. Accordingly, specialized equipment and techniques are often required for many of the operations used to form and decorate metallic containers.

Metallic containers are frequently decorated with an image or indicia, such as a brand name, logo, product information, or design by a lithographic or off-set printing process. Various examples of printing methods and apparatus are described in U.S. Pat. Nos. 3,960,073; 4,384,518; 5,233,922; 6,550,389; 6,899,998; 9,475,276; 9,573,358, 9,884,478; U.S. Patent App. Pub. No. 2009/0128590; U.S. Patent App. Pub. No. 2012/0272846; U.S. Patent App. Pub. No. 2014/0360394; U.S. Patent App. Pub. 2014/0373741; U.S. Patent App. Pub. No. 2015/0183211; U.S. Patent App. Pub. No. 2015/0128819; U.S. Patent App. Pub. No. 2015/0217559; U.S. Patent App. Pub. No. 2015/0128821; U.S. Patent App. Pub. No. 2016/0229198; U.S. Patent App. Pub. No. 2017/0008270; U.S. Patent App. Pub. No. 2018/0126724; WIPO Publication No. WO 2014/006517; WIPO Publication No. WO 2014/008544; WIPO Publication No. WO 2013/113616; WIPO Publication No. WO 2014/108489; and WIPO Publication No. WO 2014/128200 each of which are each incorporated herein by reference in their entireties.

Referring now to FIG. 1, a prior art decorator 2 is generally illustrated. The decorator 2 includes an infeed conveyor 4 which receives undecorated metallic containers 6A and directs them to a support cylinder 8. The support cylinder includes pockets with mandrels that receive the metallic containers. When positioned on the mandrels, the metallic containers 6 are decorated by being brought into contact with a transfer blanket 12 on a blanket wheel or cylinder 10. The transfer blankets 12 transfer ink images to the metallic containers 6.

The transfer blankets 12 receive the ink image from printing plates 16 positioned on plate cylinders 14. A decorator 2 can have a plurality of plate cylinders 14 that each have an associated inking assembly 18. For example, decorators used to decorate metallic containers 6 frequently have from four to nine plate cylinders 14 which each have an associated ink assembly. Each inking assembly 18 transfers a single color of ink to the printing plate 16 of a single associated plate cylinder 14. When ink has been transferred from a printing plate 16 of each plate cylinder to a transfer blanket 12, the final lithographic ink image is formed on the transfer blanket 12. For example, if the decorator 2 includes six plate cylinders 14, a printing plate 16 of each of the six plate cylinders will transfer ink to a single transfer blanket 12 to form the lithographic image.

After receiving an ink image from a transfer blanket 12, the decorated metallic containers 6B can receive a protective coating from a varnish unit 42. The varnish unit 42 may include a roller to apply the protective coating to the exterior surfaces of the metallic containers. The decorated metallic containers 6B are then transported from the decorator 2 by a conveyor, such as a pin chain (not illustrated).

Referring now to FIG. 2, a schematic view of a prior art inking assembly 18 is shown. The inking assembly 18 includes a number of rollers that transfer ink 22 from an ink fountain 20 to a printing plate 16 on a plate cylinder 14. The printing plate 16 can then transfer the ink 22 to a transfer blanket 12 on the blanket cylinder 10 of the decorator 2. Inking assemblies 18 typically include a fountain or ink roller 24 that picks up ink 22 from the ink fountain 20. The amount or thickness of ink picked up by the ink roller 24 is controlled by ink keys or blades (not illustrated) spaced along an axis of the ink roller.

A ductor roller 26 receives ink 22 from the ink roller 24. The ductor roller 26 transfers ink to a distributor or transfer roller 28. The transfer roller 28 subsequently transfers the ink to additional downstream rollers. The downstream rollers can include a second transfer roller 30, a first oscillator roller 32, a third transfer roller 34, a second oscillator roller 36, a form roller 38, and a rider roller 40. The form roller 38 transfers the ink to the printing plate 16 on the plate cylinder 14. The ink is subsequently transferred to the transfer blanket 12 as an ink image which is then transferred to the exterior surface of the metallic container 6. The number of downstream rollers and their positions and functions may vary in prior art decorators.

In operation, the ductor roller 26 pivots or oscillates at high speed between two positions in which the ductor roller is alternately in direct contact with one of the ink roller 24 and the transfer roller 28. The ductor roller 26 is illustrated in broken lines in a first position in contact with the ink roller 24. A second position of the ductor roller 26 is illustrated in FIG. 2 in solid lines. In the second position the ductor roller 26 is in contact with the transfer roller 28. The ductor roller 26 is only in contact with one of the ink roller 24 and the transfer roller 28 at any given time. An actuator, such as an air cylinder, moves the ductor roller 26 between the first and second positions. In some prior art inking assemblies 18, the ductor roller 26 may move from the first position to the second position at speeds up to 20 or 30 times per minute. Examples of prior art inking assemblies 18 and ductor rollers 26 are described in U.S. Pat. No. 9,475,276, U.S. Pat. App. Pub. 2014/0373741, U.S. Pat. App. Pub. 2015/0128819, U.S. Pat. App. Pub. 2017/0008270, and U.S. Pat. App. Pub. 2018/0126724 which are each incorporated herein in their entirety by reference.

The oscillations of the ductor roller 26 may cause significant problems in a decorator. For example, the constant motion of the ductor roller 26 from the ink roller 24 to the transfer roller 28 causes wear to all three rollers 24, 26, 28. Moving parts, such as bearings, roller surfaces, and actuators are subject to continuous force and shock from impact of the ductor roller 26 with the ink roller 24 and the transfer roller 28 resulting in wear. Increased wear results in more downtime, which adds considerable loss in production and costs in a metal container manufacturing plant.

The ductor roller 26 is also a significant source of heat in the inking assembly 18 of some prior art decorators 2. Some of the heat is caused by friction as the ductor roller 26 contacts the ink roller 24 or the transfer roller 28. The ductor roller 26 is not driven but is configured to rotate freely due to contact with the ink roller 24 and the transfer roller 28. However, the transfer roller 28 is driven. In some prior art decorators 2, the transfer roller 28 spins at a rate that may be up to fifty times faster than the ink roller 24. Consequently, the ductor roller 26 changes speed dramatically during each oscillation. The ductor roller 26 accelerates rapidly upon contact with the transfer roller 28 and then suddenly decelerates when the ductor roller moves into contact with the ink roller 24.

The sudden acceleration of the ductor roller 26 caused by contact with the transfer roller 28 causes problems in addition to heat and wear. For example, the sudden acceleration of the ductor roller 26 can also throw or sling ink droplets from the ductor roller 26. This is known as "ink misting." The ink mist wastes ink and can form spots on the printing plate, decreasing the quality of a decoration on a metallic container. The ductor roller 26 may also skid upon contacting the transfer roller 28 which results in uneven ink flow through the inking assembly 18 and deficient decorations formed on the metallic containers 6. This can also result in increased downtime and production delay.

The heat generated by the ductor roller 26 can change the viscosity of the ink. Some prior art decorators 2 attempt to control the heat by cooling one or more of the rollers 28, 30, 38. For example, U.S. Pat. App. Pub. 2014/0373741 describes channels through shafts of three transfer rollers. A coolant, such as water, is fed through the channels to maintain the temperature of the rollers. This system adds to the complexity and cost of prior art decorators.

The cycle time (or frequency) of the oscillations of the ductor roller 26 can be adjusted to alter the amount of ink 22 transferred to the printing plate 16. The amount of time the ductor roller 26 remains in contact with the ink roller 24, known as the dwell time, also effects the quantity of ink transferred to the printing plate 16. Accordingly, an operator may adjust the cycle time and the dwell time to alter the amount of ink transferred to the printing plate.

Producing acceptable decorations on metallic containers 6 with prior art decorators 2 is dependent upon the skill and attentiveness of the operator and requires considerable labor and associated expense. More specifically, for each production run to decorate metallic containers, the decorator 2 must be set up to produce a new decoration. Setting up the decorator is a task that requires skill and is dependent on the experience of the operator. To step up the decorator, the operator must typically position new printing plates 16 on each of the plate cylinders 14. The inking assemblies 18 associated with each of the plate cylinders 14 must then be adjusted to transfer the correct amount of ink 22 to their associated printing plates 16. This can include adjusting ink keys or ink blades of the ink fountains 20 and then setting the cycle time and the dwell time for the ductor roller 26.

Unfortunately, setting the cycle time and the dwell time to correctly transfer an acceptable amount of ink 22 to the printing plates 16 is challenging. Operators are often left to guessing or trial and error when adjusting the ductor roller 26 before arriving at settings of the cycle time and dwell time that produce an acceptable ink transfer to the printing plate 16. If the dwell time is too great, an excessive amount of ink may accumulate on the ductor roller 26 during contact with the ink roller 24. The excess ink may subsequently be slung from the ductor roller when the ductor roller slams into the transfer roller 28 and when the ductor roller quickly accelerates upon contact with the transfer roller.

Another problem results when the movement of the ductor roller 26 from the ink roller 24 to the transfer roller 28 occurs while the form roller 38 is transferring ink 22 to the printing plate 16. When the ductor roller 26 contacts the transfer roller 28, the ductor roller 26 applies a force to the transfer roller 28. The force may be transferred to the printing plate 16 as vibrations through the rollers 30-38 downstream of the transfer roller 28. This is known as "ductor shock." If the cycle time of the ductor roller 26 is improperly adjusted, the printing plate 16 will be in contact with the form roller 38 when the ductor roller 26 slams into the transfer roller 28. The resulting ductor shock can result in an improper application of ink 22 to an image formed on the printing plate 16 and degrade the quality of the decoration formed by the printing plate.

There is little uniformity in the dwell times and cycle times of ductor rollers 26 in decorators 2. Operators tend to set the cycle time and dwell time based on their own preferences. The lack of uniformity can cause problems as operators attempt to set up a decorator for a production run.

These issues and others decrease the efficiency of prior art decorators 2 and waste production time. Because some metallic container production lines may print in excess of 15 different decorations each day, the decorator 2 may be out of production many hours each day during set-up and calibration to prepare the decorator to print different decorations. Considering the high production speeds at which metallic container production lines typically operate, this is a considerable amount of down time and lost productivity.

Additionally, the movement and heat generated by the ductor roller 26 and friction caused by contact of the ductor roller with the transfer roller 28 and the ink roller 24 can result in significant downtime of the decorator for service and replacement of parts. Further, in 2018 the Applicant spent approximately $180,000 just for parts and service associated with ductor rollers 26 of decorators.

The heat and vibrations caused by movement of the ductor roller can also cause problems during a production run. For example, if the inking assembly of a prior art decorator is set up at the beginning of the production run, the heat generated by friction of the ductor roller and the vibrations of the ductor roller can alter the transfer of ink to the printing plate and the transfer blanket. More specifically, varying temperatures of components of prior art inking assemblies can detrimentally affect the transfer of ink through the inking assembly.

Due to these and other limitations of existing inking assemblies of decorators used to decorate metallic containers, there is an unmet need for an inking assembly that is easier to operate and adjust, which generates less heat and waste, requires less operator time, and is less susceptible to human error than prior art inking assemblies without sacrificing production efficiency or image quality in a high-speed beverage container production system.

SUMMARY

One aspect of the present disclosure is a novel metering roller for an inking assembly of a decorator operable to decorate cylindrical exterior surfaces of metallic containers. The inking assembly includes an ink roller configured to receive ink from an ink fountain. The ink fountain includes ink blades to control a thickness and volume of ink received by the ink roller. The metering roller is positioned downstream from the ink roller to selectively receive ink from the ink roller. A transfer roller is positioned downstream from the metering roller to selectively receive ink from the metering roller.

An adjustment mechanism is configured and operable to move the metering roller from a first ink transfer position to a second dwell position. In the first ink transfer position, the metering roller is in contact with the transfer roller and transfers ink to the transfer roller. However, the metering roller is spaced a first distance from the ink roller. The first distance creates an ink gap between the metering roller and the ink roller. The first distance is no greater than the thickness of ink on the ink roller. Accordingly, although the metering roller does not contact the ink roller when in the first ink transfer position, the metering roller receives ink from the ink roller. In this manner, when the decorator is decorating metallic containers, the metering roller remains in the first ink transfer position in contact with the transfer roller but does not contact the ink roller. When the decorator is not decorating metallic containers, the adjustment mechanism can move the metering roller to the second dwell position. In the second dwell position, the metering roller is spaced from the ink roller by a second distance that is greater than the first distance. The second distance is greater than the thickness of ink on the ink roller. Accordingly, in the second dwell position the metering roller does not receive ink from the ink roller and does not transfer ink to the transfer roller.

In one embodiment, the metering roller is also spaced from the transfer roller when in the second dwell position. Accordingly, in one embodiment, when in the second dwell position the metering roller does not contact or transfer ink to the transfer roller.

Another aspect of the present disclosure is an inking assembly that includes a drive element operable to rotate an ink roller at a predetermined rate that can be varied. The rate of rotation of the ink roller does not affect, and is not dependent upon, a rate or rotation of a metering roller downstream from the ink roller. The drive element can vary the rotation rate of the ink roller to alter an amount of ink transferred to the metering roller.

In one embodiment, the rate of rotation of the ink roller is directly related to the amount of ink transferred to the metering roller. For example, when the drive element rotates the ink roller at a first rate, a first amount of ink can be transferred to the metering roller in a predetermined period of time.

The drive element can also rotate the ink roller at a second rate that is faster than the first rate. When the drive element rotates the ink roller at the second rate, a second amount of ink that is greater than the first amount of ink can be transferred to the metering roller in the predetermined period of time.

One aspect of the present disclosure is an inking assembly for a decorator. The inking assembly generally includes an ink roller, a metering roller, and a transfer roller. A first drive element is configured to rotate the ink roller at a predetermined first rate that is variable. Optionally, the inking assembly includes a second drive element that is associated with the transfer roller. The second drive element can rotate the transfer roller at a second rate. The second rate can be at least equal to the first rate. In one embodiment, the second rate is faster than the first rate. In another embodiment, the second rate may be slower than the first rate.

The inking assembly can also optionally include an adjustment mechanism. The adjustment mechanism of the inking assembly can move the metering roller from a first ink transfer position to a second dwell position. In one embodiment, the metering roller is configured to freely rotate around an axis. Optionally, the axis is defined by an axle. When in the first ink transfer position, the metering roller is in contact with the transfer roller and receives a rotational force from the transfer roller. In one embodiment, the metering roller does not contact or receive a rotational force from the ink roller.

Another aspect of the present disclosure is a non-transitory computer readable medium including instructions configured to cause a processor of a control system to automatically adjust components of an inking assembly of a decorator of one embodiment of the present disclosure. The instructions include instructions that cause the processor to one or more of: (1) receive information from a sensor related to a metallic container decorated by the decorator; (2) determine whether the decoration is acceptable or is deficient; (3) if the decoration is deficient, the instructions cause the processor to determine if a component of the inking assembly can be adjusted to correct the deficient; and (4) send a signal to alter a setting of one or more components of the inking assembly to alter an amount of ink transferred to subsequent metallic containers.

The control system can send the signal to at least one of an actuator associated with an ink blade, a first drive element, an adjustment mechanism, and a second drive element of the inking assembly. The signal can cause an actuator to alter a position of an ink blade with respect to an ink roller. A first drive element can alter a rate of rotation of the ink roller in response to receiving a signal from the control system. Similarly, the second drive element can alter a rate of rotation of at least one of a transfer roller and a metering roller in response to a signal sent from the control system. The control system can optionally send a signal to the adjustment mechanism to alter a distance between the metering roller and the ink roller.

One aspect of the present disclosure is an inking assembly for a decorator configured to decorate an exterior surface of a metallic container. The inking assembly comprises: (1) an ink fountain to provide a supply of ink; (2) an ink roller to receive ink from the ink fountain; (3) a first drive element configured to rotate the ink roller at a predetermined rate; (4) a metering roller with a first ink transfer position to receive ink from the ink roller and a second dwell position in which the metering roller does not receive ink from the ink roller; and (5) a transfer roller positioned downstream from the metering roller.

In the first ink transfer position the metering roller is spaced a first distance from the ink roller. The first distance is no greater than a thickness of ink on the ink roller.

In one embodiment, the first distance is at least approximately 0.002 inches. The first distance can be less than approximately 0.045 inches. Accordingly, the first distance may be between approximately 0.002 inches and approximately 0.045 inches.

Additionally, in one embodiment, the metering roller is in continuous contact with and transfers ink to the transfer roller in the first ink transfer position. When the decorator is decorating metallic containers, the metering roller can remain in the first ink transfer position in contact with the transfer roller, but not the ink roller. More specifically, the metering roller does not contact the ink roller when the metering roller is in either the first ink transfer position or when the metering roller is in the second dwell position. However, the metering roller remains in the first ink transfer position to continuously contact the transfer roller when the decorator is decorating metallic containers.

In the second dwell position the metering roller is spaced a second distance from the ink roller, the second distance being greater than the first distance. In one embodiment, the second distance is at least greater than the thickness of ink on the ink roller.

Optionally, the second distance can be least approximately 0.045 inches or at least approximately 0.090 inches. In another embodiment, the second distance is less than approximately 0.3 inches, or between approximately 0.045 inches and approximately 0.3 inches.

In addition, in one embodiment, the metering roller is spaced a predetermined third distance from the transfer roller in the second dwell position. Accordingly, in one embodiment, the metering roller does not contact the transfer roller in the second dwell position.

Optionally, the third distance can be greater than approximately 0.03 inches. In one embodiment, the third distance is less than approximately 0.1 inches. More specifically, the third distance optionally is between approximately 0.03 inches and approximately 0.1 inches.

Alternatively, in another embodiment, an axle of the metering roller is positioned a fixed distance from an axle of the transfer roller. Accordingly, the metering roller is in contact with the transfer roller in both the first ink transfer position and in the second dwell position.

The inking assembly can further include an optional adjustment mechanism associated with the metering roller. The adjustment mechanism is configured to move the metering roller from the first ink transfer position to the second dwell position.

In one embodiment, the adjustment mechanism is interconnected to the axle of the metering roller. Accordingly, in one embodiment, the adjustment mechanism moves the axle of the metering roller away from an axle of the ink roller to transfer the metering roller from the first ink transfer position to the second dwell position. The axle of the metering roller is approximately parallel to the axle of the ink roller and the axle of the transfer roller.

The axle of the ink roller and the axle of the transfer roller define a first plane. In one embodiment, the adjustment mechanism can move the axle of the metering roller transverse to the first plane. Optionally, the adjustment mechanism can move the axle of the metering roller approximately perpendicular relative to the first plane.

In one embodiment, the adjustment mechanism moves the axle of the metering roller away from the first plane when transferring the metering roller to the second dwell position. Additionally, or alternatively, the adjustment mechanism may move the axle of the metering roller toward the first plane when transferring the metering roller to the first ink transfer position.

Optionally, the adjustment mechanism moves the axle of the metering roller away from the axle of the transfer roller to transfer the metering roller from the first ink transfer position to the second dwell position. Alternatively, in another embodiment, a distance between the axle of the metering roller and the axle of the transfer roller does not change when the adjustment mechanism transfers the metering roller from the first ink transfer position to the second dwell position. In one embodiment, the adjustment mechanism rotates the metering roller around the axle of the transfer roller when transferring the metering roller between the first ink transfer position and the second dwell position.

The inking assembly optionally includes a plurality of ink blades. The ink blades are configured to adjust an amount of ink received by the ink roller such that the thickness of ink on the ink roller is adjustable.

In one embodiment, the ink blades can be set such that the thickness of ink on the ink roller is less than approximately 0.040 inches, or less than approximately 0.033 inches. In one embodiment, the ink blades can be adjusted to contact the ink roller. Accordingly, the thickness of the ink on the ink roller can be adjusted to a thickness of between approximately 0.0 inches to approximately 0.040 inches by altering a position of the ink blades relative to the ink roller.

In one embodiment, the inking assembly further comprises a first drive element configured to rotate the ink roller at a first predetermined rate. By actuating the first drive element to increase a rate of rotation of the ink roller when the metering roller is in the first ink transfer position, a volume of ink transferred to the metering roller can be increased. Similarly, decreasing the first predetermine rate of rotation of the ink roller can decrease the volume of ink transferred to the metering roller.

In one embodiment, the first drive element is configured to rotate the ink roller only when the metering roller is in the first ink transfer position. Accordingly, the first drive element does not rotate the ink roller when the metering roller is in the second dwell position.

Optionally, the inking assembly further comprises a second drive element. The second drive element is configured to rotate the transfer roller at a second predetermined rate. The second predetermined rate can be less than, equal to, or greater than the first predetermined rate of rotation of the ink roller.

In one embodiment, the second drive element is configured to rotate the transfer roller only when the metering roller is in the first ink transfer position. Accordingly, the second drive element does not rotate the transfer roller when the metering roller is in the second dwell position.

In one embodiment, the metering roller is configured to rotate in response to a force received from the transfer roller when the metering roller is in the first ink transfer position. Additionally, or alternatively, in another embodiment the second drive element is configured to rotate the metering roller at a rate that is at least equal to or faster than the rate of rotation of the ink roller.

Optionally, the transfer roller is configured to rotate in a first direction. The transfer roller can drive the metering roller to rotate in a second direction that is opposite to the first direction.

In one embodiment, the ink roller is configured to rotate in the first direction. Accordingly, in one embodiment, the metering roller rotates in a direction that is opposite to the ink roller. More specifically, the ink roller rotates in the first direction while the metering roller rotates in the second direction.

Alternatively, in another embodiment, the ink roller is configured to rotate in the second direction. Accordingly, in one embodiment, the metering roller rotates in a direction that is the same as the ink roller. Specifically, the metering roller and the ink roller can both rotate in the second direction.

In one embodiment, the decorator includes a printing plate positioned on a plate cylinder. The printing plate is configured to transfer ink to a transfer blanket positioned on a blanket cylinder of the decorator.

In one embodiment, the inking assembly further comprises at least one intermediate roller positioned downstream from the transfer roller. The intermediate roller is configured to transfer ink from the transfer roller to the printing plate. The intermediate roller is in contact with the transfer roller and the plate cylinder.

Optionally, in another embodiment, the inking assembly includes a plurality of intermediate rollers between the transfer roller and the plate cylinder. In one embodiment, the plurality of intermediate rollers can include at least one of a second transfer roller, a third transfer roller, a first oscillator roller, a second oscillator roller, a form roller, and a rider roller. At least one of the plurality of intermediate rollers is configured to contact the transfer roller. Additionally, at least one of the plurality of intermediate rollers is configured to contact the printing plate. The printing plate is operable to transfer the ink to the transfer blanket. The transfer blanket can subsequently transfer the ink to the metallic container to decorate the exterior surface of the metallic container with the ink.

Another aspect of the present disclosure is to provide a method of decorating an exterior surface of a container with an inking assembly of a decorator, comprising: (1) providing an ink fountain with a supply of ink; (2) providing an ink roller to receive ink from the ink fountain; (3) providing a metering roller positioned downstream from the ink roller; (4) providing an adjustment mechanism configured to move the metering roller from a first ink transfer position to a second dwell position; (5) providing a transfer roller positioned downstream from the metering roller; (6) providing a plate cylinder with a printing plate positioned downstream from the transfer roller; (7) moving the metering roller to the first ink transfer position with the adjustment mechanism such that the metering roller receives ink from the ink roller and transfers ink to the transfer roller; (8) transferring ink from the transfer roller to the printing plate; (9) transferring ink from the printing plate to a transfer blanket affixed to a blanket wheel of the decorator; and (10) transferring ink from the transfer blanket to the exterior surface of the container.

In the first ink transfer position the metering roller is spaced from the ink roller by a first distance. The first distance is no greater than a thickness of ink on the ink roller.

In one embodiment, the thickness of the ink on the ink roller is between approximately 0.0 inches to approximately 0.040 inches. Accordingly, the first distance can be between approximately 0.01 inches and approximately 0.40 inches. The first distance defines a first ink gap.

In the second dwell position the metering roller is spaced from the ink roller by a second distance. The second distance is greater than the first distance.

The second distance is greater than the thickness of ink on the ink roller. In one embodiment, the second distance is greater than approximately 0.033 inches, or greater than approximately 0.040 inches. For example, the second distance can be between approximately 0.033 inches and approximately 0.3 inches.

When the metering roller is in the first ink transfer position the metering roller is in continuous contact with the transfer roller. In one embodiment, the metering roller and the transfer roller are positioned a fixed distance apart. Accordingly, the metering roller is in contact with the transfer roller in both the first ink transfer position and the second dwell position.

Alternatively, in another embodiment, the positioned of the metering roller relative to the transfer roller is adjustable. Accordingly, in one embodiment the metering roller is spaced a predetermined third distance from the transfer roller in the second dwell position such that the metering roller does not contract the transfer roller.

In one embodiment, the method further includes stopping rotation of the ink roller when the metering roller is in the second dwell position. Optionally, the method may include stopping rotation of the transfer roller when the metering roller is in the second dwell position.

The method may optionally include actuating the adjustment mechanism to transfer the metering roller from the first ink transfer position to the second dwell position. In this manner, the transfer of ink to the printing plate can be interrupted.

In one embodiment, the adjustment mechanism moves an axle of the metering roller away from an axle of the ink roller to transfer the metering roller from the first ink transfer position to the second dwell position. Optionally, the adjustment mechanism moves the axle of the metering roller away from an axle of the transfer roller to transfer the metering roller from the first ink transfer position to the second dwell position. Alternatively, in another embodiment, a distance between the axle of the metering roller and the axle of the transfer roller does not change when the adjustment mechanism transfers the metering roller from the first ink transfer position to the second dwell position.

The axle of the ink roller and the axle of the transfer roller define a first plane. In one embodiment, the adjustment mechanism moves the axle of the metering roller transverse to the first plane when moving the metering roller from the first ink transfer position to the second dwell position.

Additionally, or alternatively, the method can further comprise increasing a rate of rotation of the ink roller to increase a volume of ink transferred to the printing plate. Alternatively, the method may include decreasing the rate of rotation of the ink roller to decrease the volume of ink transferred to the printing plate.

Optionally, the ink roller may rotate a rate faster than a rate of rotation of the metering roller. In another embodiment, the rate of rotation of the ink roller is less than the rate of rotation of the metering roller.

The method may further include rotating the transfer roller in a first direction. In one embodiment, the metering roller rotates in response to contact with the transfer roller. Accordingly, the metering roller can rotate in a second direction that is opposite to the first direction.

The method may include rotating the ink roller in the first direction. Accordingly, the ink roller can rotate in the first direction while the metering roller rotates in the second direction.

In another embodiment, the method includes rotating the ink roller in the second direction. Accordingly, the ink roller and the metering roller can both rotate in the second direction.

Optionally, the method further includes moving an ink blade relative to the ink roller. In this manner, the thickness of ink on a portion of the ink roller can be adjusted. In one embodiment, the ink blade can be spaced from a surface of the ink roller by up to approximately 0.045 inches. In this manner, the thickness of ink on the ink roller can be up to approximately 0.045 inches. Accordingly, in one embodiment, when the metering roller is in the second dwell position, the second distance between the metering roller and the ink roller is greater than approximately 0.045 inches.

In one embodiment, transferring ink from the transfer roller to the printing plate includes transferring the ink from the transfer roller to an intermediate roller. The intermediate roller is positioned between the transfer roller and the plate cylinder. Optionally, the inking assembly may include a plurality of intermediate rollers positioned between the transfer roller and the plate cylinder.

The method may further comprise collecting data on a decoration formed on the exterior surface of the metallic container with a sensor. A control system can determine whether the decoration is deficient using the data received from the sensor. If the decoration is deficient, the control system can send a signal to the inking assembly to alter the amount of ink transferred to the printing plate.

In one embodiment, the control system can determine when a density of ink in the decoration is insufficient. In response, the control system can send a signal to the inking assembly to increase an amount of ink transferred to the printing late. The signal may cause a first drive to increase a rate of rotation of the ink roller such that the ink roller can transfer an increased amount of ink to the metering roller. Additionally, or alternatively, the signal can cause the adjustment mechanism to move the metering roller closer to the ink roller such that the metering roller collects more ink from the ink roller. In one embodiment, the signal can cause an actuator associated with an ink key of the ink fountain to move away from the ink roller such that a thickness of ink on the ink roller is increased.

Alternatively, the control system can determine a density of ink in the decoration is excessive. In response, the control system can a signal to the inking assembly to decrease the amount of ink transferred to the printing late. The signal can cause the first drive to decrease the rate of rotation of the ink roller such that the ink roller will transfer a decreased amount of ink to the metering roller. Additionally, or alternatively, the signal may cause the adjustment mechanism to move the metering roller away from the ink roller such that the metering roller collects less ink from the ink roller. In one embodiment, the signal may cause an actuator associated with an ink key of the ink fountain to move closer to the ink roller such that the thickness of ink on the ink roller is decreased.

Yet another aspect of the present disclosure is to provide a metering roller used in an inking assembly of a decorator for selectively transferring ink between an ink roller and a transfer roller to decorate an exterior surface of a metallic container in a container decorating plant. The metering roller generally includes, but is not limited to: (1) a cylindrical body with an exterior surface adapted to receive ink from the ink roller and transfer the ink to the transfer roller; (2) an axle extending through the cylindrical body that is supported at one or more of a first end and a second end; and (3) an adjustment mechanism operably engaged to the axle, the adjustment mechanism configured to move the metering roller from a first ink transfer position in which the metering roller is in contact with the transfer roller positioned downstream from the metering roller to a second dwell position in which the metering roller is not in contact with the transfer roller. In the first ink transfer position, the metering roller can receive ink from the ink roller and subsequently transfer the ink to the transfer roller.

The cylindrical body is configured to rotate around the axle. More specifically, in one embodiment the metering roller rotates in response to a force received from contact with the transfer roller when the metering roller is in the first ink transfer position. Additionally, or alternatively, the metering roller may be driven by a second drive unit.

During operation, the metering roller is positioned in the first ink transfer position with the exterior surface a first distance from the ink roller. In the first ink transfer position the exterior surface of the metering roller is in contact with the transfer roller.

The first distance is defined by a first gap between the exterior surface of the metering roller and an exterior surface of the ink roller. The first distance can be between approximately 0.002 inches and approximately 0.05 inches.

Optionally, the first distance can be adjusted during operation of the decorator to alter the amount of ink transferred from the ink roller to the metering roller. More specifically, the adjustment mechanism can move the metering roller closer to the ink roller while the metering roller is in the first ink transfer position. In this manner, the amount of ink received by the metering roller from the ink roller can be increased. Alternatively, the adjustment mechanism can move the metering roller further from the ink roller to decrease the amount of ink the metering roller receives from the ink roller while in the first ink transfer position.

The adjustment mechanism can move the metering roller to the second dwell position to interrupt the transfer of ink to the transfer roller. In the second dwell position, the exterior surface of the metering roller is a second distance from the ink roller, the second distance being greater than the first distance.

The second distance is defined by a second gap between the exterior surface of the metering roller and the exterior surface of the ink roller. In one embodiment, the second distance is greater than a thickness of ink on the ink roller. The second distance can be greater than approximately 0.040 inches, or greater than approximately 0.045 inches. Optionally, the second distance is at least approximately 0.090 inches. In one embodiment, the second distance is between approximately 0.040 inches and approximately 0.30 inches.

In one embodiment, the adjustment mechanism moves the axle of the metering roller away from an axle of the ink roller to move the metering roller from the first ink transfer position to the second dwell position. In another embodiment, the adjustment mechanism moves the axle of the metering roller away from an axle of the transfer roller when the adjustment mechanism moves the metering roller from the first ink transfer position to the second dwell position.

The exterior surface of the cylindrical body comprises one or more of a rubber, a plastic, a ceramic, and a metal such as steel. In one embodiment, the exterior surface of the cylindrical body can include grooves, knurls, or cross-hatching. The exterior surface may also include cells to receive ink from the ink roller. Alternatively, the exterior surface of the cylindrical body can be substantially smooth.

These and other advantages will be apparent from this disclosure. The above-described embodiments, objectives, and configurations are neither complete nor exhaustive. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more clear from the Detailed Description, particularly when taken together with the drawings.

As will be appreciated, other embodiments are possible using, alone or in combination, one or more of the features set forth above or described below. Further, the Summary is neither intended nor should it be construed as representing the full extent and scope of the present disclosure. As will be appreciated, other embodiments are possible using, alone or in combination, one or more of the features set forth above or described below. For example, it is contemplated that various features and elements shown and/or described with respect to one embodiment or figure may be combined with or substituted for features or elements of other embodiments or figures regardless of whether or not such a combination or substitution is specifically shown or described herein.

Although generally referred to herein as "metallic container," "beverage container," "can," and "container," it should be appreciated that the current invention may be used to decorate containers of any size or shape including, without limitation, beverage cans, beverage bottles, and aerosol containers. Accordingly, the term "container" is intended to cover containers of any type or shape for any product and is not specifically limited to a beverage container such as a soft drink or beer can. The containers may also be in any state of manufacture and may be formed by a draw and ironing process or by an impact extrusion process. Thus, the current invention can be used to decorate "a cup" that is subsequently formed into a finished container, a "bottle preform" that is subsequently formed into a metallic bottle, or a "tube" that is formed into an aerosol container body.

The terms "metal" or "metallic" as used hereinto refer to any metallic material that may be used to form a container, including without limitation aluminum, steel, tin, and any combination thereof. However, it will be appreciated that the apparatus and method of the present invention can be used in various forms and embodiments to decorate containers formed of any material, including paper, plastic, and glass.

The phrases "at least one," "one or more," "or," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, ratios, ranges, and so forth used in the specification and claims are to be understood as being modified in all instances by the term "about" or "approximately". Accordingly, unless otherwise indicated, all numbers expressing quantities, dimensions, conditions, ratios, ranges, and so forth used in the specification and claims can be increased or decreased by approximately 5% to achieve satisfactory results. In addition, all ranges described herein may be reduced to any sub-range or portion of the range, or to any value within the range without deviating from the invention.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and Claims themselves.

BRIEF DESCRIPTION OF THE DRAWINGS

The accompanying drawings, which are incorporated in and constitute a part of the specification, illustrate embodiments of the disclosed system and together with the general description of the disclosure given above and the detailed description of the drawings given below, serve to explain the principles of the disclosed system(s) and device(s).

Figure 1:
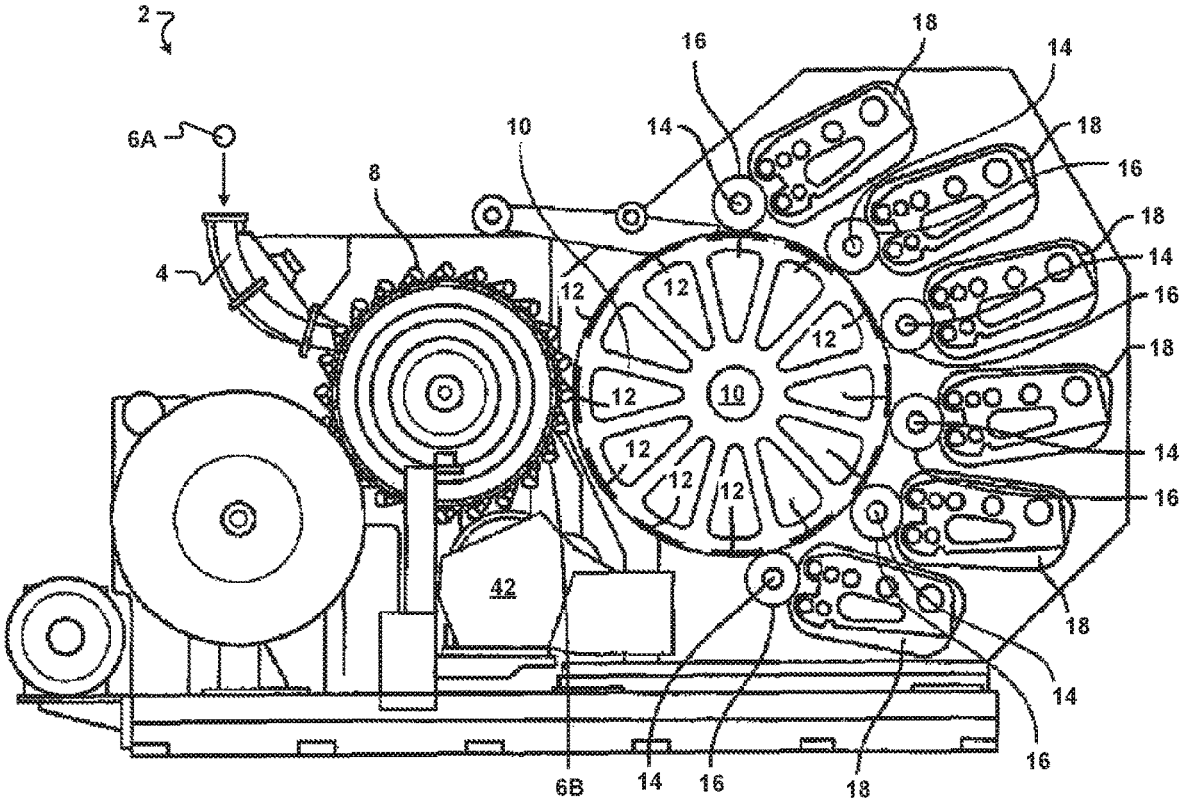
Fig. 1 (Prior Art)
FIG. 1 is a side elevation view of a prior art decorator.

The drawings may be, but are not necessarily, drawn to scale. In certain instances, details that are not necessary for an understanding of the disclosure or that render other details difficult to perceive may have been omitted. It should be understood, of course, that the disclosure is not necessarily limited to the embodiments illustrated herein. As will be appreciated, other embodiments are possible using, alone or in combination, one or more of the features set forth above or described below. For example, it is contemplated that various features and devices shown and/or described with respect to one embodiment may be combined with or substituted for features or devices of other embodiments regardless of whether or not such a combination or substitution is specifically shown or described herein.

The following is a listing of components according to various embodiments of the present disclosure, and as shown in the drawings:

| Number | Component |
|---|---|
| 2 | Decorator |
| 4 | Infeed conveyor |
| 6 | Metallic container |
| 6A | Undecorated metallic container |
| 6B | Decorated metallic container |
| 8 | Support cylinder or transport wheel |
| 10 | Blanket cylinder |
| 12 | Transfer blanket |
| 14 | Plate cylinder |
| 16 | Printing plate |
| 18 | Inking assembly of the prior art |
| 20 | Ink fountain |
| 22 | Ink |
| 24 | Ink roller |
| 26 | Ductor roller |
| 28 | Transfer roller |
| 30 | Second transfer roller |
| 32 | First oscillator roller |
| 34 | Third transfer roller |
| 36 | Second oscillator roller |
| 38 | Form roller |
| 40 | Rider roller |
| 42 | Varnish unit |
| 44 | Decorator |
| 46 | Inking assembly |
| 48 | Ink fountain |
| 50 | Ink blade |
| 52 | Actuator |
| 54 | Position sensor or potentiometer |
| 56 | Ink roller |
| 57 | Axle of ink roller |
| 58 | First drive element |
| 60 | Metering roller |
| 62 | Axle of metering roller |
| 64 | Gap |
| 66 | First ink transfer position |
| 68 | Second dwell position |
| 70 | First distance |
| 72 | Second distance |
| 74 | Adjustment mechanism |
| 76 | Transfer roller |
| 77 | Axle of transfer roller |
| 78 | Frame |
| 79 | First plane between axles of the ink roller and the transfer roller |
| 80 | Third distance between transfer roller and metering roller |
| 82 | Second gap |
| 84 | Second drive element |
| 86 | Intermediate rollers |
| 88 | Support element |
| 90 | Control system |
| 92 | Bus |
| 94 | CPU |
| 96 | Input devices |
| 98 | Output devices |
| 100 | Storage devices |
| 102 | Computer readable storage media reader |
| 104 | Communications system |
| 106 | Working memory |
| 108 | Processing acceleration unit |
| 110 | Database |
| 112 | Network |
| 114 | Remote storage device/database |
| 116 | Operating system |
| 118 | Other code |
| 120 | Sensor |
| 122 | Light |
| 124 | Actuator |
| 126 | Shaft |

DETAILED DESCRIPTION

To acquaint persons skilled in the pertinent arts most closely related to the present disclosure, a preferred embodiment that illustrates the best mode now contemplated for putting the invention into practice is described herein by, and with reference to, the annexed drawings that form a part of the specification. Exemplary embodiments are described in detail without attempting to describe all of the various forms and modifications in which the invention might be embodied. As such, the embodiments described herein are illustrative, and as will become apparent to those skilled in the arts, may be modified in numerous ways within the scope and spirit of the disclosure.

Referring now to FIGS. 3-8, an inking assembly 46 according to one embodiment of the present disclosure is generally illustrated. The inking assembly 46 generally includes an ink fountain 48 configured to hold a supply of ink 22. An ink roller 56 is associated with the ink fountain 48.

Figure 7:
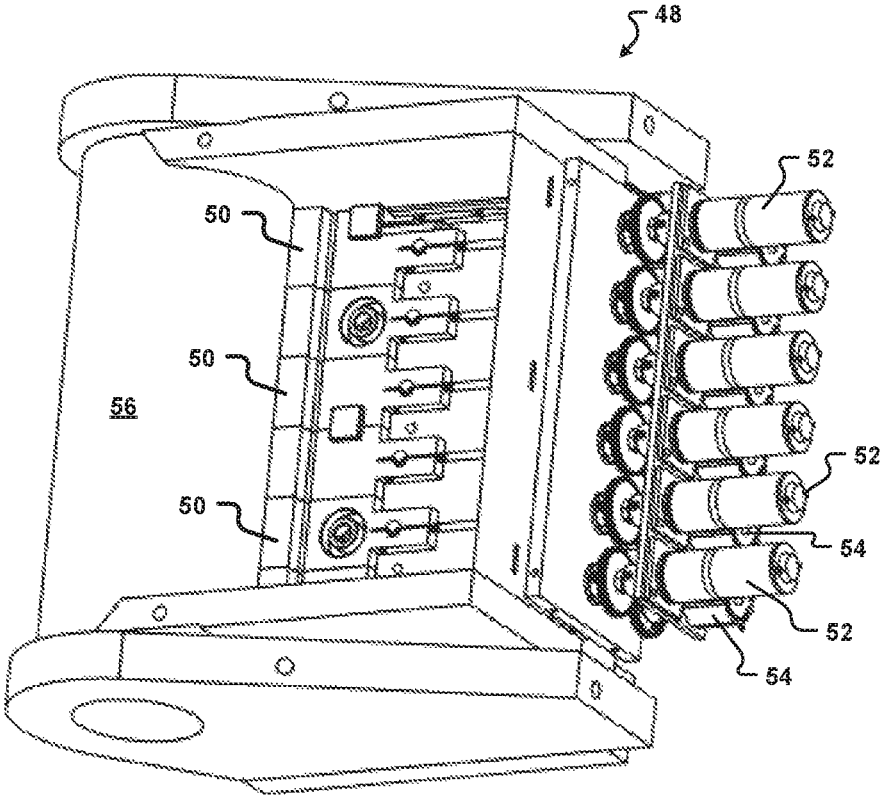
FIG. 7 is a top perspective view of an ink fountain of an embodiment of the present disclosure which generally illustrates ink blades in relation to an ink roller of the present disclosure.

Referring now to FIG. 7, the ink fountain 48 includes ink blades 50 that are individually adjustable relative to the ink roller 56. The ink blades 50 control an amount (or a thickness) of ink picked up by the ink roller 56. The ink blades can be individually moved to increase or decrease the thickness of ink 22 picked up by the ink roller 56. For example, the ink blades 50 can be moved away from the ink roller to increase the thickness of ink picked up by the ink roller. Alternatively, the ink blades 50 can be moved closer to the ink roller 56 to decrease a gap between the ink blades and the ink roller. In this manner, the amount of ink 22 transferred to the ink roller 56 can be decreased. In one embodiment, ink blades 50 can be adjusted such that the ink roller 56 can receive a coating of ink 22 with a thickness of up to approximately 0.045 inches from the ink fountain 48. More specifically, in one embodiment the thickness of ink on the ink roller 56 can be adjusted to a thickness of between approximately 0.0 inches and approximately 0.045 inches by altering a position of the ink blades 50 relative to the ink roller. In one embodiment, the ink blades can be adjusted to contact the ink roller.

In one embodiment, the ink fountain 48 includes an actuator 52 associated with each of the ink blades 50. Each actuator 52 is configured to move an associated ink blade 50 relative to ink roller 56. The actuators 52 can be controlled by a control system 90 of the present disclosure.

Optionally, a position sensor 54 is associated with each of the ink blades 50. The position sensor 54 can determine a position of an ink blade 50 relative to the ink roller 56. Additionally, or alternatively, the position sensor 54 can detect and measure movement of an ink blade. In one embodiment, the position sensor 54 can provide data collected about an ink blade to the control system 90. The ink fountain 48, ink blades 50, actuators 52, and position sensor 54 can be the same as, or similar to, those described in U.S. Pat. App. Pub. 2018/0024076 or U.S. Pat. App. Pub. 2018/0201011 which are each incorporated herein by reference in their entirety.

Figure 8:
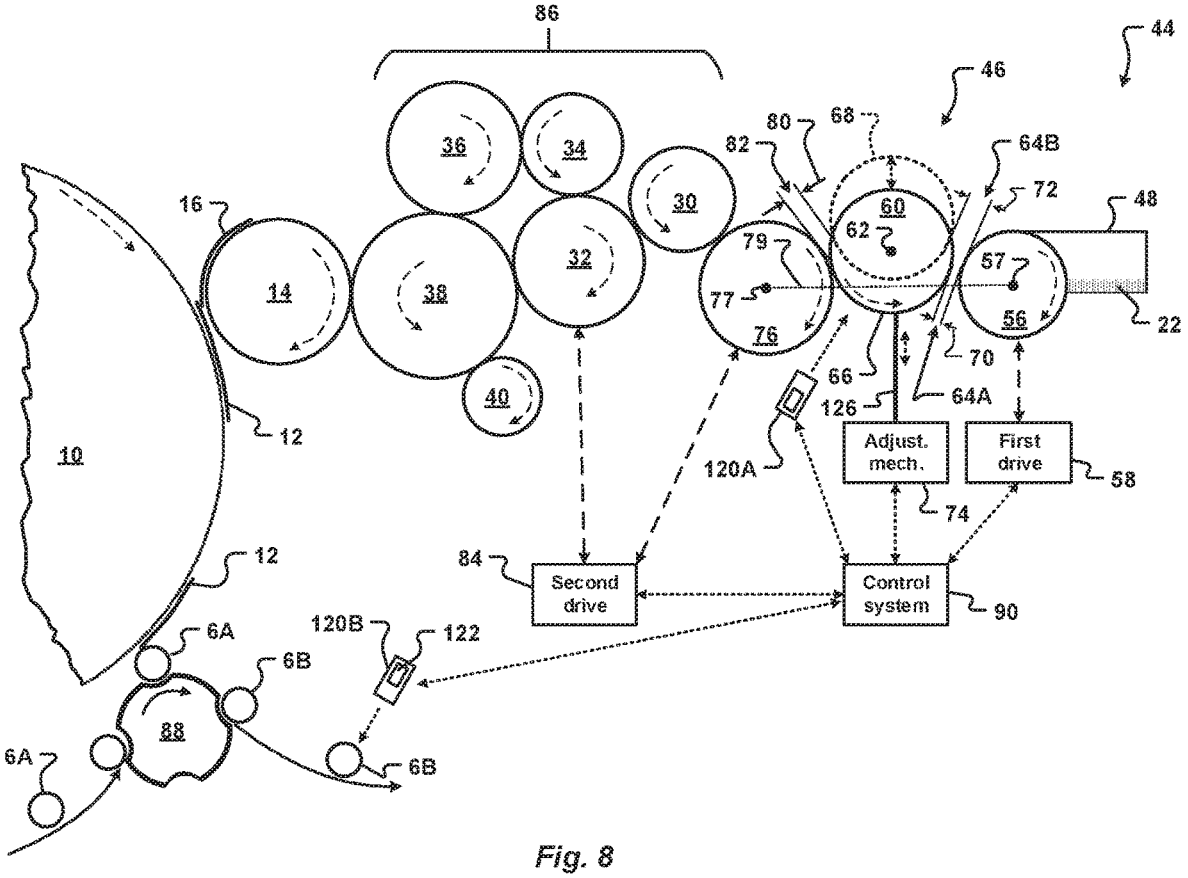
FIG. 8 is a schematic view of a portion of a decorator of the present disclosure and generally illustrating an inking assembly including a metering roller of an embodiment of the present disclosure.

Referring to FIG. 8, optionally a first drive element 58 is associated with the ink roller. The first drive element 58 can rotate the ink roller 56 at a first rate that is predetermined. The ink roller 56 can receive ink from the ink fountain 48 as the ink roller 56 rotates through the ink 22.

The first drive element 58 may be an electric motor. Optionally, the first drive element is a servo drive. Suitable drive elements are known to those of skill in the art. In one embodiment, the first drive element 58 can be controlled by the control system 90. Optionally, the first drive element 58 can rotate the ink roller 56 at up to approximately 100 rotations per minutes (RPM). In one embodiment, the first drive element 58 can rotate the ink roller at up to approximately 500 RPM. In another embodiment, the first drive element rotates the ink roller 56 at a rate of between approximately 10 RPM and approximately 500 RPM. In one embodiment, the first drive element 58 is interconnected to a shaft or axle 57 around which the ink roller 56 rotates. Optionally, the first drive element 58 includes one or more of a gear, a chain, a belt, and a shaft that are interconnected to the axle.

In one embodiment, the rate of rotation of the ink roller 56 is directly related to the amount of ink 22 that the ink roller 56 can transfer to a downstream metering roller 60 in a predetermined period of time. For example, when the first drive element 58 rotates the ink roller 56 at a first rate, a first amount of ink 22 is picked up by the ink roller and can be transferred to the metering roller 60 in the predetermined period of time. When the first drive element 58 rotates the ink roller 56 at a second rate that is faster than the first rate, a second amount of ink 22 is picked up by the ink roller and can be transferred to the metering roller 60 in the predetermined period of time. Because the ink roller 56 is rotating faster at the second rate, more of the exterior surface of the ink roller 56 passes through the ink in the ink fountain 48 and thus picks up ink than when the ink roller 56 is rotating at the first rate. Accordingly, the ink roller 56 receives and can transfer more ink 22 in the predetermined period of time when rotating at the second rate than when rotating at the first rate.

The metering roller 60 is positioned downstream from the ink roller 56 and can selectively receive ink 22 from the ink roller 56. The metering roller 60 has a shape that is generally cylindrical. Ink from the ink roller collects on an exterior surface of the metering roller. The exterior surface has a cylindrical shape. In one embodiment the metering roller 60 is configured to rotate freely around an axis. The axis may be defined by an axle 62.

Optionally, the metering roller 60 can receive ink 22 from the ink roller 56 without contacting the ink roller. More specifically, in one embodiment, the metering roller 60 is spaced from the ink roller 56 by a gap 64 as generally illustrated in FIG. 8. In another embodiment, the cylindrical exterior surface of the metering roller 60 never contacts an exterior surface of the ink roller 56.

The exterior surface of the metering roller 60 is adapted to receive ink from the ink roller 56. In one embodiment, the exterior surface of the metering roller comprises a resilient or an elastomeric material. Optionally, the exterior surface may include one or more of a rubber, a plastic, a ceramic, and a metal such as steel. In one embodiment, the exterior surface of the cylindrical body includes grooves, knurls, or cross-hatching. Additionally, or alternatively, the exterior surface may also include cells to receive ink from the ink roller. Alternatively, the exterior surface of the cylindrical body of the metering roller 60 can be substantially smooth.

The ink roller 56 has a first diameter, the metering roller 60 has a second diameter, and the transfer roller 76 has a third diameter. In one embodiment, the first diameter is greater than the second diameter. Alternatively, the first diameter is less than the second diameter. Optionally, the first and second diameters may be approximately equal.

In another embodiment, the first diameter is greater than the third diameter. Alternatively, the first diameter is less than the third diameter. Optionally, the first and third diameters may be approximately equal.

In one embodiment, the second diameter is greater than the third diameter. Alternatively, the second diameter is less than the third diameter. Optionally, the second and third diameters may be approximately equal.

An adjustment mechanism 74 is configured to alter the gap 64 by moving the metering roller 60 from a first ink transfer position 66 to a second dwell position 68. In one embodiment, the adjustment mechanism 74 can be controlled by the control system 90.

The metering roller 60 is generally illustrated in FIG. 8 in solid lines in the first ink transfer position 66. In the first ink transfer position 66, the gap 64A defines a first distance 70 (generally illustrated in FIG. 5) that the metering roller 60 is spaced from the ink roller 56. The first distance 70 is no greater than the thickness of ink 22 on the ink roller 56. Accordingly, although in one embodiment the metering roller 60 does not contact the ink roller 56 in the first ink transfer position 66, the metering roller 60 can receive ink from the ink roller. The metering roller 60 generally remains in the first ink transfer position 66 while the decorator 44 is decorating metallic containers 6 during a decoration run.

The gap 64A between the metering roller 60 and the ink roller 56 reduces or eliminates friction and reduces heat during ink transfer to the metering roller 60 during the decoration run. The gap 64A also eliminates wear to the metering roller 60 and the ink roller 56 since they do not contact each other.

In contrast, in a prior art decorator 2 a ductor roller 26 repeatedly oscillates into and out of contact with an ink roller 24 and a transfer roller 28 during a decoration run. The frequent contact of the ductor roller with the ink roller and transfer roller cause a great deal of wear to all three rollers 24, 26, 28 of the prior art decorator.

Figure 5:
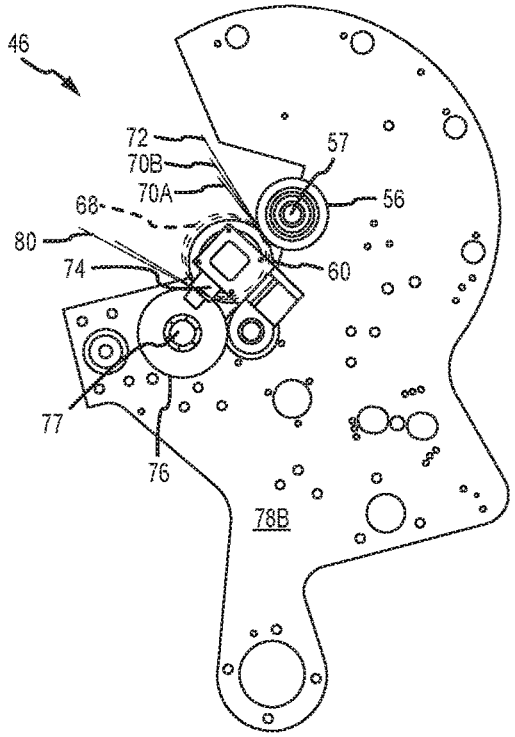
FIG. 5 is a side elevation view of the portion of the inking assembly of FIG. 4.
Figure 6:
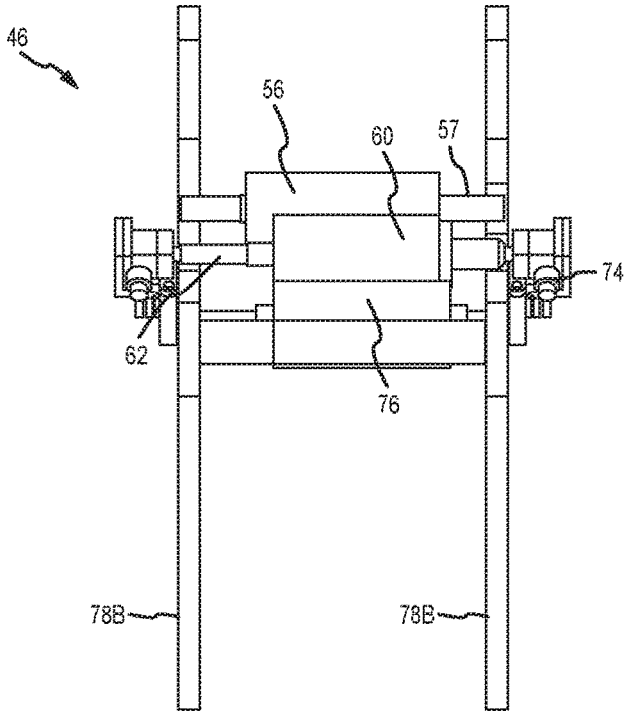
FIG. 6 is a front elevation view of the portion of the inking assembly of FIG. 4.

Referring to FIG. 5, the first distance 70A can be at least approximately 0.002 inches. In one embodiment, the first distance 70B can be less than approximately 0.045 inches. Optionally, the adjustment mechanism 74 can move the metering roller 60 while in the first ink transfer position such that the first distance is between approximately 0.002 inches and approximately 0.05 inches.

As the first distance 70 decreases, the amount of ink 22 transferred to the metering roller 60 generally increases. Alternatively, as the first distance 70 increases, the amount of ink 22 transferred to the metering roller 60 generally decreases. In this manner, the adjustment mechanism 74 is operable to alter the amount of ink 22 transferred to the metering roller 60.

In one embodiment, the adjustment mechanism 74 generally includes an actuator 124 that is configured to move the metering roller. The actuator may be a low voltage DC motor. In another embodiment, the actuator 124 includes a solenoid interconnected to the metering roller 60. Additionally, or alternatively, the adjustment mechanism 74 may optionally include one or more of a gear, a lever, and a shaft interconnected to the axle 62 of metering roller 60.

Figure 3:
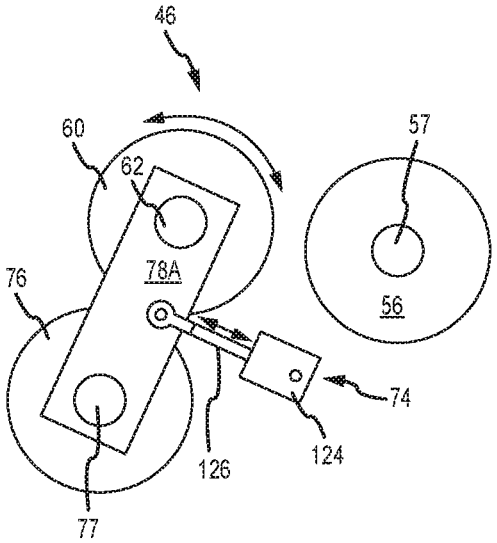
FIG. 3 is a side elevation view of an ink roller, a metering roller, and a transfer roller of an inking assembly of one embodiment of the present disclosure.

Optionally, the adjustment mechanism 74 includes a shaft 126 associated with the metering roller 60. In one embodiment, the shaft is interconnected to a frame 78 that supports an axle 62 of the metering roller 60 as generally illustrated in FIG. 3.

Figure 4:
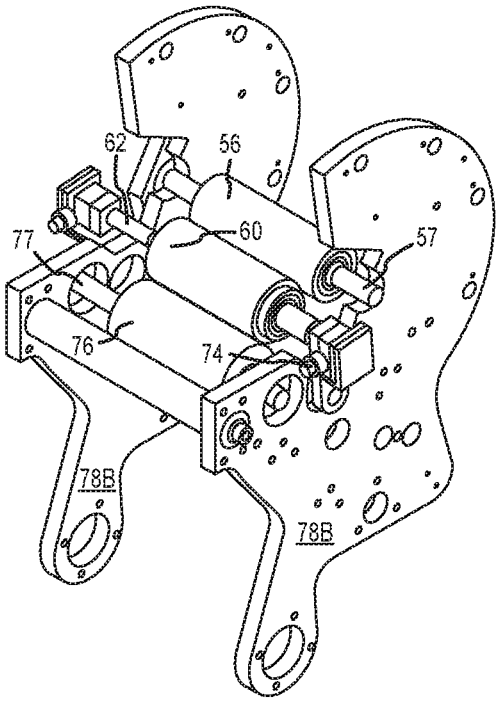
FIG. 4 is a side perspective view of a portion of an inking assembly of another embodiment of the present disclosure and illustrating an ink roller, a metering roller, and a transfer roller.

Alternatively, the actuator shaft 126 can be connected directly to the axle 62 as generally illustrated in FIG. 4. The actuator 124 can move the shaft 126 to alter the position of the metering roller 60.

The metering roller 60 is generally illustrated in dashed lines in FIG. 8 in the second dwell position 68. When the decorator 44 is not decorating metallic containers 6, the adjustment mechanism 74 can move the metering roller 60 to the second dwell position 68. In the second dwell position 68, the metering roller 60 is spaced from the ink roller 56 by a second distance 72 that defines a gap 64B that is larger than gap 64A. The second distance 72 (illustrated in FIG. 5) is greater than the first distance 70 and is also greater than the thickness of ink 22 on the ink roller 56. Accordingly, in the second dwell position 68 the metering roller 60 does not receive ink 22 from the ink roller 56.

The second distance 72 can be at least approximately 0.045 inches, approximately 0.06 inches, or greater than approximately 0.090 inches as generally illustrated in FIG. 5. In one embodiment, the second distance is between approximately 0.045 inches and approximately 0.40 inches.

A transfer roller 76 is positioned downstream from the metering roller 60. The metering roller 60 transfers ink to the transfer roller. Accordingly, the metering roller is separated from a plate cylinder 14 of the inking assembly 46 by at least the transfer roller 76. In one embodiment, at least one intermediate roller 86 is positioned between the transfer roller 76 and the plate cylinder 14. Optionally, a plurality of intermediate rollers 86 are positioned between the transfer roller 76 and the plate cylinder 14.

The transfer roller 76 can be driven to rotate by a second drive element 84. The second drive element 84 can be interconnected to the transfer roller 76. In one embodiment, the transfer roller 76 receives a rotational force from one or more of a belt, a gear, a shaft, and a chain driven by the second drive element. Optionally, the second drive element 84 is interconnected to a shaft or an axle 77 of the transfer roller. Alternatively, the second drive element 84 can cause the transfer roller 76 to rotate by applying a rotational force to at least one intermediate roller 86 of the inking assembly 46. The driven intermediate roller 86 can transfer the rotational force to the transfer roller 76. More specifically, in one embodiment the second drive element can drive a first oscillator roller 32 of the intermediate rollers 86.

The second drive element 84 may be the same as or different from the first drive element 58. Optionally, the second drive element 84 is an electric motor. The second drive element may be a servo drive.

The transfer roller 76 can selectively receive ink 22 from the metering roller 60 in the first ink transfer position 66. In one embodiment, the metering roller 60 is configured to contact the transfer roller 76 in the first ink transfer position 66. In this manner, the metering roller can transfer ink 22 to the transfer roller 76.

The metering roller 60 receives a rotational force from the transfer roller 76 during the contract with the transfer roller 76. The rotational force causes the metering roller 60 to rotate around its axis defined by the axle 62.

Optionally, the second drive element 84 can rotate the transfer roller 76 such that the metering roller 60 can rotate at a rate of greater than 50 RPM, for example, up to at least approximately 500 RPM. In one embodiment, the second drive element 84 rotates the transfer roller 76 at between approximately 25 RPM and approximately 700 RPM. In another embodiment, contact between the metering roller and the transfer roller 76 causes the metering roller 60 to rotate at a rate at least equal to the rate of rotation of the ink roller 56. Alternatively, the second drive element 84 can adjust the rate of rotation of the metering roller to be less than, equal to, or greater than the rate of rotation of the ink roller.

In one embodiment, the second drive element 84 is configured to rotate the transfer roller 76 in a first direction as generally illustrated in FIG. 8. The transfer roller 76 can drive the metering roller 60 to rotate in a second direction that is opposite to the first direction.

In one embodiment, the first drive element 58 is configured to rotate the ink roller 56 in the first direction. Accordingly, in one embodiment, the metering roller 60 rotates in a direction that is opposite to the ink roller 56. More specifically, the ink roller 56 rotates in the first direction while the metering roller rotates 60 in the second direction.

Alternatively, in another embodiment, the first drive element 58 is configured to rotate the ink roller 56 in the second direction. Accordingly, in one embodiment, the metering roller rotates in a direction that is the same as the ink roller. Specifically, the metering roller 60 and the ink roller 56 can both rotate in the second direction.

The transfer roller 76 can transfer ink 22 to the plurality of intermediate rollers 86 positioned downstream from the transfer roller. At least one of the intermediate rollers 86 can transfer ink 22 to a printing plate 16 affixed to a plate cylinder 14. In one embodiment, a form roller transfers 38 the ink 22 to the printing plate 16.

When the decorator 44 is in a decoration run, the printing plate 16 can transfer ink to a transfer blanket 12 positioned on a blanket cylinder 10. The transfer blanket 12 subsequently transfers the ink to an undecorated metallic container 6A. In one embodiment, the decorator 44 includes a support element 88 to move the undecorated metallic container 6A into contact with the transfer blanket. The support element 88 can include a plurality of stations to receive and support metallic containers 6 in a predetermined position with respect to the blanket cylinder 10. In one embodiment, the stations of the support element 88 include mandrels to support the metallic containers. Suitable support elements are known to those of skill in the art.

Figure 2:
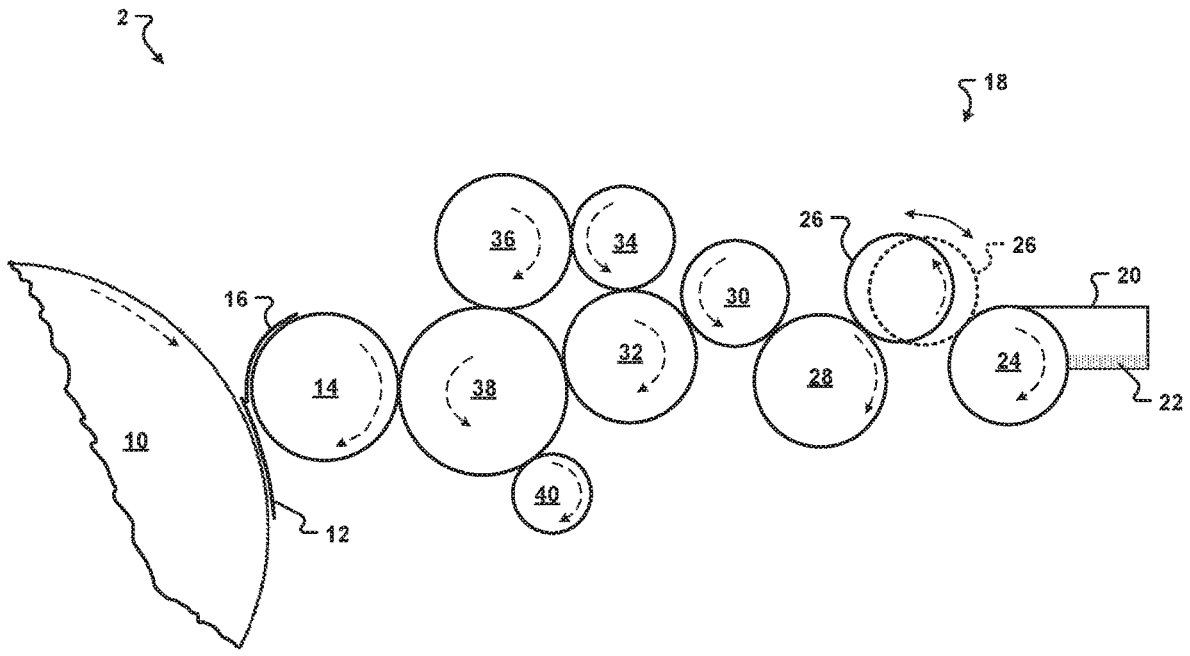
Fig. 2 (Prior Art)
FIG. 2 is a schematic view of a prior art inking assembly of a prior art decorator.

The intermediate rollers 86 can be the same as or similar to rollers 30-40 downstream from a transfer roller 28 of a prior art inking assembly 18 such as illustrated in FIG. 2. For example, FIG. 8 generally illustrates one embodiment of the inking assembly 46 of the current disclosure in which the intermediate rollers 86 can include, but are not limited to, one or more of a second transfer roller 30, a first oscillator roller 32, a third transfer roller 34, a second oscillator roller 36, a form roller 38, and a rider roller 40.

The arrangement and number of intermediate rollers 86 of the inking assembly 46 of the present disclosure can be varied. In one embodiment, the inking assembly does not include any intermediate rollers 86. In another embodiment, the inking assembly includes one intermediate roller 86. Alternatively, in another embodiment, the inking assembly 46 has two intermediate rollers.

When the decorator 44 is decorating metallic containers 6, the metering roller 60 remains in the first ink transfer position 66. In one embodiment, the metering roller 60 is in continuous contact with the transfer roller 76 when in the first ink transfer position 66.

In contrast, as described above, the ductor roller 26 of the prior art inking assembly 18 rapidly oscillates into and out of contact with the transfer roller 28 when the prior art decorator 2 is decorating containers. Accordingly, the metering roller 60 of the present disclosure is not subjected to rapid acceleration and deceleration such as the prior art ductor roller 26.

The continuous contact of the metering roller 60 with the transfer roller 76 during a decoration run reduces wear and heat due to friction compared to the prior art inking assembly 18. In addition, the metering roller 60 can rotate at a generally uniform rate during a decoration run, reducing or eliminating misting and slinging of ink within the inking assembly 46 of the present disclosure. In this manner, the inking assembly 46 of the present disclosure wastes less ink than a prior art inking assembly 18. Eliminating the misting and slinging of ink also reduces or eliminates unintended or inadvertent transfer of ink drops to printing plates 16 and transfer blankets 12 of the decorator 44, thereby improving the quality of decorations formed on the metallic containers 6.

The continuous contact between the metering roller 60 and the transfer roller 76 also improves the uniformity of ink transferred to the transfer roller. More specifically, the ductor roller 26 of the prior art inking assembly skids and accelerates or decelerates upon contact with the prior art transfer roller 28 which results in an uneven application of ink on the surface of the transfer roller. Further, the prior art ductor roller 26 only contacts the transfer roller 28 intermittently such that the exterior surface of the transfer roller intermittently receives ink. In contrast, the metering roller 60 of the present disclosure substantially constantly transfers an even layer of ink to the transfer roller 76.

Further, the continuous contact of the metering roller 60 with the transfer roller 76 during a decoration run means the transfer roller does not receive force or shocks from the metering roller 60. In contrast, as explained herein, a prior art ductor roller 26 slams into the transfer roller 28 between 20 to 30 times per minute. The force from each impact of the ductor roller into the transfer roller can be transferred downstream to the printing plate as vibrations or "ductor shock" which degrades the quality of the ink image formed on the printing plate.

In one embodiment, generally illustrated in FIG. 3, the metering roller 60 and the transfer roller 76 are interconnected to a frame 78A. The frame 78A keeps the spacing between the metering roller 60 and the transfer roller 76 constant. More specifically, the axle 62 of the metering roller 60 and an axle 77 of the transfer roller 76 are held a fixed distance apart by the frame 78A. Accordingly, when in the second dwell position 68, the metering roller 60 of one embodiment can remain in continuous contact with the transfer roller 76. In one embodiment, the adjustment mechanism 74 is configured to rotate the metering roller 60 around a pivot point, such as the axle 77 of the transfer roller 76.

Alternatively, and referring again to FIG. 8, in another embodiment when the adjustment mechanism 74 moves the metering roller 60 to the second dwell position 68, the metering roller 60 is separated by a third distance 80 from the transfer roller 76. The third distance 80 defines a second gap 82 between the metering roller 60 and the transfer roller 76. Accordingly, the transfer of ink 22 from the metering roller 60 to the transfer roller 76 is interrupted in the second dwell position 68. Additionally, the metering roller 60 does not receive a rotational force from the transfer roller 76 in the second dwell position 68 of the embodiment of FIG. 8. The metering roller 60 may thus stop rotating in the second dwell position 68.

In one embodiment, the third distance 80 is at least approximately 0.03 inches. In another embodiment, the third distance is less than approximately 0.1 inches. Optionally, the third distance can be between approximately 0.03 inches and approximately 0.30 inches.

In one embodiment, the axle 62 of the metering roller 60 is approximately parallel to the axle 57 of the ink roller 56 and to the axle 77 of the transfer roller 76. As generally illustrated in FIG. 8, the axle 57 of the ink roller and the axle 77 of the transfer roller define a first plane 79. In one embodiment, the adjustment mechanism 74 is configured to move the axle 62 of the metering roller 60 transverse to the first plane 79. In another embodiment, the adjustment mechanism 74 can move the metering roller axle 62 approximately perpendicular relative to the first plane 79.

In one embodiment, the adjustment mechanism 74 moves the axle 62 of the metering roller 60 away from the first plane 79 when moving the metering roller to the second dwell position 68. Additionally, or alternatively, the adjustment mechanism may move the axle 62 of the metering roller 60 toward the first plane 79 when moving the metering roller to the first ink transfer position 66.

Additionally, or alternatively, in one embodiment, the adjustment mechanism 74 moves the axle 62 of the metering roller 60 away from an axle 57 of the ink roller 56 to move the metering roller from the first ink transfer position 66 to the second dwell position 68. Optionally, the adjustment mechanism 74 moves the axle 62 of the metering roller 60 away from the axle 77 of the transfer roller 76 to move the metering roller from the first ink transfer position 66 to the second dwell position 68.

Alternatively, in another embodiment, a distance between the axle 62 of the metering roller 60 and the axle 77 of the transfer roller 76 is fixed and does not change when the adjustment mechanism 74 moves the metering roller from the first ink transfer position to the second dwell position.

In one embodiment, the first drive element 58 is configured to rotate the ink roller 56 only when the metering roller 60 is in the first ink transfer position 66. Accordingly, the first drive element 58 may stop providing a rotation force to the ink roller when the metering roller is in the second dwell position 68.

In another embodiment, the second drive element 84 is configured to rotate the transfer roller 76 only when the metering roller 60 is in the first ink transfer position 66. Accordingly, the second drive element 84 may not provide a rotational force to the transfer roller 76 when the metering roller 60 is in the second dwell position 68.

Figure 9:
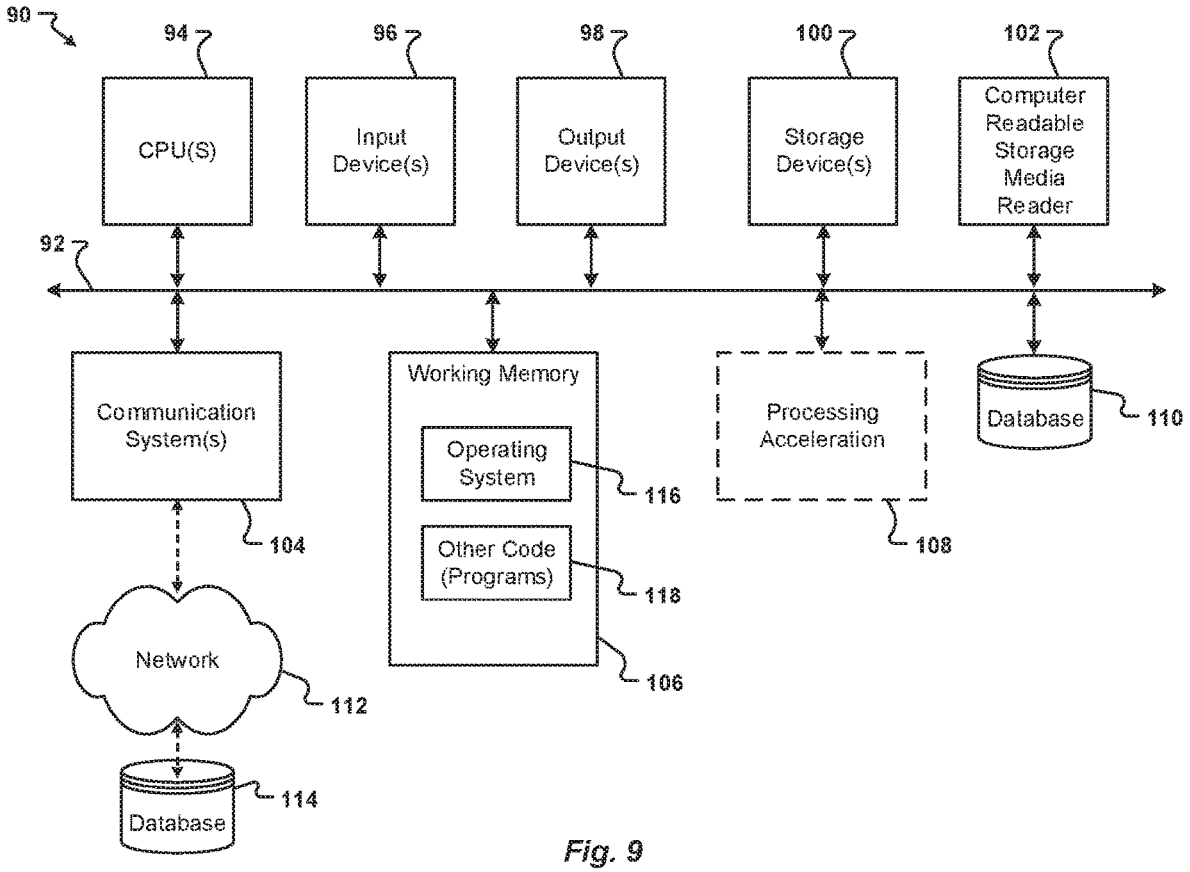
FIG. 9 is a block diagram of an embodiment of a control system of the present invention.

Referring now to FIG. 9, an embodiment of a control system 90 of the present disclosure is generally illustrated. More specifically, FIG. 9 illustrates one embodiment of a control system 90 of the present disclosure operable to control elements of the inking assembly 46 of the present disclosure. The control system 90 is generally illustrated with hardware elements that may be electrically coupled via a bus 92. The hardware elements may include one or more central processing units (CPUs) 94; one or more input devices 96 (e.g., a mouse, a keyboard, etc.); and one or more output devices 98 (e.g., a display device, a printer, etc.). The control system 90 may also include one or more storage devices 100. In one embodiment, the storage device(s) 100 may be disk drives, optical storage devices, solid-state storage device such as a random access memory ("RAM") and/or a read-only memory ("ROM"), which can be programmable, flash-updateable and/or the like.

The control system 90 may additionally include one or more of a computer-readable storage media reader 102; a communications system 104 (e.g., a modem, a network card (wireless or wired), an infra-red communication device, etc.); and working memory 106, which may include RAM and ROM devices as described above. In some embodiments, the control system 90 may also include a processing acceleration unit 108, which can include a DSP, a special-purpose processor and/or the like. Optionally, the control system 90 may also include a database 110.

The computer-readable storage media reader 102 can further be connected to a computer-readable storage medium, together (and, optionally, in combination with storage device(s) 100) comprehensively representing remote, local, fixed, and/or removable storage devices plus storage media for temporarily and/or more permanently containing computer-readable information. The communications system 104 may permit data to be exchanged with a network 112 and/or any other data-processing. Optionally, the control system 90 may access data stored in a remote storage device, such as database 114 by connection to the network 112. In one embodiment, the network 112 may be the internet.

The control system 90 may also comprise software elements, shown as being currently located within the working memory 106. The software elements may include an operating system 116 and/or other code 118, such as program code implementing one or more methods and aspects of the present invention.

One of skill in the art will appreciate that alternate embodiments of the control system 90 may have numerous variations from that described above. For example, customized hardware might also be used and/or particular elements might be implemented in hardware, software (including portable software, such as applets), or both. Further, connection to other computing devices such as network input/output devices may be employed.

In one embodiment, the control system 90 is a personal computer, such as, but not limited to, a personal computer running the MS Windows operating system. Optionally, the control system 90 can be a smart phone, a tablet computer, a laptop computer, and similar computing devices. In one embodiment, the control system 90 is a data processing system which includes one or more of, but is not limited to: at least one input device (e.g. a keyboard, a mouse, or a touch-screen); an output device (e.g. a display, a speaker); a graphics card; a communication device (e.g. an Ethernet card or wireless communication device); permanent memory (such as a hard drive); temporary memory (for example, random access memory); computer instructions stored in the permanent memory and/or the temporary memory; and a processor. The control system 90 may be any programmable logic controller (PLC). One example of a suitable PLC is a Controllogix PLC produced by Rockwell Automation, Inc., although other PLCs are contemplated for use with embodiments of the present invention.

In one embodiment, the control system 90 is in communication with one or more of the inking assemblies 46 of a decorator 44 of the present disclosure. Optionally, the control system 90 can send instructions to one or more of an actuator 52 associated with an ink blade 50, the first drive element 58, the adjustment mechanism 74, and the second drive element 84 to adjust an amount of ink 22 transferred in a decoration to a metallic container 6.

Additionally, or alternatively, the control system 90 can receive information from sensors of the decorator. For example, the control system 90 can receive information from a position sensor 54 associated with an ink blade 50.

The control system 90 can also receive data from sensors of an inspection system. For example, the control system may receive data from a sensor 120A associated with the metering roller 60. In one embodiment, the sensor 120A collects data on the ink on the metering roller. The sensor 120A can determine the thickness of the ink on the metering roller. In this manner, if data from the sensor 120 indicates that an improper amount of ink is on the metering roller 60 (such as too much or too little ink 22), the control system 90 can send a signal to one or more elements of the inking assembly 46 to adjust the amount of ink transferred from the ink roller to the transfer roller.

Optionally, the control system 90 can send a signal to an actuator 52 of an ink blade 50 to move the ink blade closer too, or away from, the ink roller 56. In this manner, the control system can increase or decrease the thickness of ink on the ink roller to alter the amount of ink transferred to the metering roller 60.

Additionally, or alternatively, the control system 90 can send a signal to the first drive element 58 to alter the rate of rotation of the ink roller 56. By increasing the rate of rotation of the ink roller, the control system can increase the amount of ink transferred to the metering roller 60. Alternatively, by decreasing the rate of rotation of the ink roller 56, the control system 90 can decrease the amount of ink 22 transferred to the metering roller 60.

Further, the control system 90 may additionally, or alternatively, send a signal to the adjustment mechanism 74 to adjust the gap 64 and the first distance 70 between the metering roller 60 and the ink roller 56 to adjust the amount of ink the metering roller receives from the ink roller. For example, by increasing the first distance 70, the control system can decrease the amount of ink transferred from the ink roller to the metering roller 60. Alternatively, by decreasing the first distance 70 and the size of the gap 64A, the control system 90 can increase the amount of ink 22 transferred to the metering roller 60.

The inspection system can also include a sensor 120B configured to collect data on a decoration formed on an exterior surface of a metallic container 6B decorated by the decorator 44. Examples of inspection systems that can be used with the inking assembly 46 and decorator 44 of the present disclosure are generally described in U.S. Pat. No. 9,862,204, U.S. Pat. App. Pub. 2012/0216689, and U.S. Pat. App. Pub. 2019/0257692 which are each incorporated herein in their entirety by reference.

The control system 90 can thus receive data from one or more sensors related to decorated metallic containers 6B. For example, in one embodiment, the decorator includes a sensor 120B positioned downstream from the support element 88. The sensor 120B is oriented to collect data on a decoration formed on a cylindrical exterior surface of a decorated metallic container 6B. Optionally, although FIG. 8 illustrates only one sensor 120B, the decorator 44 may include a plurality of sensors 120 to collect data on all of the cylindrical body of the metallic container substantially simultaneously. For example, the decorator 44 can include two to five sensors 120 arranged around a longitudinal axis of the container.

In one embodiment, a light 122 is associated with the sensor 120 to illuminate the decorated metallic container 6B. In one embodiment, the light 122 comprises at least one of an incandescent lamp, an LED, a high intensity light, a laser, a fluorescent light, a xenon flash tube, and an arc discharge lamp. The light 122 is selected to generate illumination of a predetermined wavelength based on the requirements of the sensor 120. In one embodiment, the light is positioned at an angle relative to the sensor. In this manner, the light 122 can illuminate the metallic container at an angle relative to the sensor. In one embodiment, the light 122 is oriented at an angle of between about 1° and about 10° relative to a boresight of the sensor. Alternatively, the light can be oriented at an angle of between 1° and about 90° relative to the sensor boresight.

The sensor 120B is operable to collect data on the density of the decoration. In one embodiment, the sensor 120 is calibrated to a NIST color standard. Optionally the sensor can output data on the color of a decoration in one or more color standards defined by the International Commission on Illumination (CIE), including CIE XYZ, CIE LAB, CMYK, and CIERGB. Additionally, or alternatively, the sensor 120 can optionally divide or describe a color signature curve of incoming visible light into up to approximately 1,024 data points. In another embodiment, the sensor 120 can measure a variation or distance between a target color of a decoration (such as a target value for a color in one of the color spaces) and a color of an ink of a decoration on a decorated metallic container 6B. The color variation may be expressed in CIE ΔE (or "Delta E") by the sensor.

In one embodiment, the sensor 120 is a spectrophotometer. Additionally, or alternatively, the sensor 120 can be a camera. Other suitable sensors are known to those of skill in the art.

Using the data from one or more sensors, the control system 90 can determine if the decoration on the decorated metallic container is deficient or satisfactory. More specifically, the control system 90 can determine if the decoration at least meets targets corresponding to one or more parameters, such as color, density, depth, and consistency. The targets may be set by a customer or an operator of the decorator 44. One or more of the parameters may include a target range. If sensor data related to a parameter falls within lower and upper limits of the range, at least this parameter of the decoration is acceptable. In one embodiment, when a decoration on a decorated metallic container 6B does not meet one or more of the targets, the decoration is deficient.

In one embodiment, the control system 90 includes a density measurement module and an image processing module. The density measurement module and the image processing module can be software elements stored in memory 106 as other code 118.

The density measurement module includes instructions to determine the density of different inks used to form a decoration on a metallic container using data received from the sensor 120. More specifically, the density measurement module can calculate a density value as an arithmetic mean value of RGB components of pixels in an image of the decoration collected by the sensor. The RGB components can be obtained as a density difference between the density at each place or pixel and the density of the master image at a corresponding place or pixel.

In one embodiment, the image processing module can conduct a pixel by pixel comparison of an image of a decoration taken by the sensor to an image of a satisfactory decoration. The image of the satisfactory decoration may be stored in a database 110 of the control system 90 or in a database 114 that is accessible over a network 112.

The control system 90 can compare data from the sensor to the targets for the decoration. In one embodiment, the control system 90 compares data associated with an image of the decoration received from the sensor to the target level for corresponding portions of the decoration. In this manner, the control system 90 can determine if one or more of the color, density, depth (or thickness), alignment, and consistency for each portion of the decoration differs from the target values or position for each portion of the decoration. If the sensor data for a portion of the decoration differs from one or more of the target values, the control system 90 may determine that the decoration is deficient.

In the case where the control system 90 determines the density of a certain color of ink is low, the control system can send a signal to the inking assembly 46 associated with the low density color to increase the amount of ink transferred to the associated printing plate. Alternatively, in the case where the control system determines the density of a certain color is high, the control system can send a signal to the associated inking assembly 46 to decrease the amount of ink transferred to the associated printing plate. The decorator 44 may optionally have from four to twelve inking assemblies 46 that may each apply one color or type of ink to an associated printing plate.

When the control system 90 determines a decoration of a decorated metallic container 6B has a deficiency, the control system 90 can optionally determine if the deficiency can be eliminated or reduced by adjusting a component of an inking assembly 46 of the present disclosure. The control system 90 can determine a deficient decoration was caused by an improper amount of ink 22 being transferred from an inking assembly 46 to a metallic container 6. In response, the control system can send a single to one or more components of the inking assembly 46 to alter an amount of ink transferred to subsequent metallic containers 6. For example, the control system can alter an amount of ink transferred to metallic containers by an inking assembly 46 by sending a signal to one or more of: (1) an actuator 52 to alter a position of an ink blade 50; (2) a first drive element 58 to alter a rate of rotation of an ink roller 56; (3) an adjustment mechanism 74 to alter the first distance 70 of the gap 64 separating the metering roller 60 from the ink roller 56; and (4) a second drive element 84 to alter a rate of rotation of a transfer roller 76 and of the metering roller 60.

While various embodiments of the decorator of the present disclosure have been described in detail, it is apparent that modifications and alterations of those embodiments will occur to those skilled in the art. It is to be expressly understood that such modifications and alterations are within the scope and spirit of the present disclosure. Further, it is to be understood that the phraseology and terminology used herein is for the purposes of description and should not be regarded as limiting. The use of "including," "comprising," or "having" and variations thereof herein are meant to encompass the items listed thereafter and equivalents thereof, as well as, additional items.

The term "automatic" and variations thereof, as used herein, refer to any process or operation done without material human input when the process or operation is performed. However, a process or operation can be automatic, even though performance of the process or operation uses material or immaterial human input, if the input is received before the performance of the process or operation. Human input is deemed to be material if such input influences how the process or operation will be performed. Human input that consents to the performance of the process or operation is not deemed to be "material."

The term "bus" and variations thereof, as used herein, can refer to a subsystem that transfers information and/or data between various components. A bus generally refers to the collection communication hardware interface, interconnects, bus architecture, standard, and/or protocol defining the communication scheme for a communication system and/or communication network. A bus may also refer to a part of a communication hardware that interfaces the communication hardware with other components of the corresponding communication network. The bus may be for a wired network, such as a physical bus, or wireless network, such as part of an antenna or hardware that couples the communication hardware with the antenna. A bus architecture supports a defined format in which information and/or data is arranged when sent and received through a communication network. A protocol may define the format and rules of communication of a bus architecture.

A "communication modality" can refer to any protocol or standard defined or specific communication session or interaction, such as Voice-Over-Internet-Protocol ("VoIP), cellular communications (e.g., IS-95, 1G, 2G, 3G, 3.5G, 4G, 4G/IMT-Advanced standards, 3GPP, WIMAX™, GSM, CDMA, CDMA2000, EDGE, 1×EVDO, iDEN, GPRS, HSPDA, TDMA, UMA, UMTS, ITU-R, and 5G), Bluetooth™, text or instant messaging (e.g., AIM, Blauk, eBuddy, Gadu-Gadu, IBM Lotus Sametime, ICQ, iMessage, IMVU, Lync, MXit, Paltalk, Skype, Tencent QQ, Windows Live Messenger™ or Microsoft Network (MSN) Messenger™, Wireclub, Xfire, and Yahoo! Messenger™), email, Twitter (e.g., tweeting), Digital Service Protocol (DSP), and the like.

The term "communication system" or "communication network" and variations thereof, as used herein, can refer to a collection of communication components capable of one or more of transmission, relay, interconnect, control, or otherwise manipulate information or data from at least one transmitter to at least one receiver. As such, the communication may include a range of systems supporting point-to-point or broadcasting of the information or data. A communication system may refer to the collection individual communication hardware as well as the interconnects associated with and connecting the individual communication hardware. Communication hardware may refer to dedicated communication hardware or may refer a processor coupled with a communication means (i.e., an antenna) and running software capable of using the communication means to send and/or receive a signal within the communication system. Interconnect refers to some type of wired or wireless communication link that connects various components, such as communication hardware, within a communication system. A communication network may refer to a specific setup of a communication system with the collection of individual communication hardware and interconnects having some definable network topography. A communication network may include wired and/or wireless network having a pre-set to an ad hoc network structure.

The term "computer-readable medium," as used herein refers to any tangible storage and/or transmission medium that participates in providing instructions to a processor for execution. Such a medium may take many forms, including but not limited to, non-volatile media, volatile media, and transmission media. Non-volatile media includes, for example, non-volatile random access memory (NVRAM), or magnetic or optical disks. Volatile media includes dynamic memory, such as main memory. Common forms of computer-readable media include, for example, a floppy disk, a flexible disk, hard disk, magnetic tape, or any other magnetic medium, magneto-optical medium, read only memory (ROM), a compact disc read only memory (CD-ROM), any other optical medium, punch cards, paper tape, any other physical medium with patterns of holes, a random access memory (RAM), a programmable read only memory (PROM), and erasable programmable read only memory EPROM, a FLASH-EPROM, a solid state medium like a memory card, any other memory chip or cartridge, a carrier wave as described hereinafter, or any other medium from which a computer can read. A digital file attachment to an e-mail or other self-contained information archive or set of archives is considered a distribution medium equivalent to a tangible storage medium. When the computer-readable media is configured as a database, it is to be understood that the database may be any type of database, such as relational, hierarchical, object-oriented, and/or the like. Accordingly, the disclosure is considered to include a tangible storage medium or distribution medium and prior art-recognized equivalents and successor media, in which the software implementations of the present disclosure are stored. It should be noted that any computer readable medium that is not a signal transmission may be considered non-transitory.

The terms display and variations thereof, as used herein, may be used interchangeably and can be any panel and/or area of an output device that can display information to an operator or use. Displays may include, but are not limited to, one or more control panel(s), instrument housing(s), indicator(s), gauge(s), meter(s), light(s), computer(s), screen(s), display(s), heads-up display HUD unit(s), and graphical user interface(s).

The term "module" as used herein refers to any known or later developed hardware, software, firmware, artificial intelligence, fuzzy logic, or combination of hardware and software that is capable of performing the functionality associated with that element.

The term "desktop" refers to a metaphor used to portray systems. A desktop is generally considered a "surface" that may include pictures, called icons, widgets, folders, etc. that can activate and/or show applications, windows, cabinets, files, folders, documents, and other graphical items. The icons are generally selectable to initiate a task through user interface interaction to allow a user to execute applications and/or conduct other operations.

The term "displayed image" refers to an image produced on the display. A typical displayed image is a window or desktop. The displayed image may occupy all or a portion of the display.

The term "electronic address" can refer to any contactable address, including a telephone number, instant message handle, e-mail address, Uniform Resource Locator ("URL"), Global Universal Identifier ("GUID"), Universal Resource Identifier ("URI"), Address of Record ("AOR"), electronic alias in a database, etc., combinations thereof.

The term "screen," "touch screen," "touchscreen," or "touch-sensitive display" refers to a physical structure that enables the user to interact with the computer by touching areas on the screen and provides information to a user through a display. The touch screen may sense user contact in a number of different ways, such as by a change in an electrical parameter (e.g., resistance or capacitance), acoustic wave variations, infrared radiation proximity detection, light variation detection, and the like. In a resistive touch screen, for example, normally separated conductive and resistive metallic layers in the screen pass an electrical current. When a user touches the screen, the two layers make contact in the contacted location, whereby a change in electrical field is noted and the coordinates of the contacted location calculated. In a capacitive touch screen, a capacitive layer stores electrical charge, which is discharged to the user upon contact with the touch screen, causing a decrease in the charge of the capacitive layer. The decrease is measured, and the contacted location coordinates determined. In a surface acoustic wave touch screen, an acoustic wave is transmitted through the screen, and the acoustic wave is disturbed by user contact. A receiving transducer detects the user contact instance and determines the contacted location coordinates.

The term "window" refers to a, typically rectangular, displayed image on at least part of a display that contains or provides content different from the rest of the screen. The window may obscure the desktop. The dimensions and orientation of the window may be configurable either by another module or by a user. When the window is expanded, the window can occupy substantially all of the display space on a screen or screens.

The terms "determine," "calculate," and "compute," and variations thereof, as used herein, are used interchangeably and include any type of methodology, process, mathematical operation, or technique.

While the exemplary aspects, embodiments, options, and/or configurations illustrated herein show the various components of the system collocated, certain components of the system can be located remotely, at distant portions of a distributed network, such as a local area network (LAN) and/or the Internet, or within a dedicated system. Thus, it should be appreciated, that the components of the system can be combined in to one or more devices, such as a Personal Computer (PC), laptop, netbook, smart phone, Personal Digital Assistant (PDA), tablet, etc., or collocated on a particular node of a distributed network, such as an analog and/or digital telecommunications network, a packet-switch network, or a circuit-switched network. It will be appreciated from the preceding description, and for reasons of computational efficiency, that the components of the system can be arranged at any location within a distributed network of components without affecting the operation of the system. For example, the various components can be located in a switch such as a private branch exchange (PBX) and media server, gateway, in one or more communications devices, at one or more users' premises, or some combination thereof. Similarly, one or more functional portions of the system could be distributed between a telecommunications device(s) and an associated computing device.

Furthermore, it should be appreciated that the various links connecting the elements can be wired or wireless links, or any combination thereof, or any other known or later developed element(s) that is capable of supplying and/or communicating data to and from the connected elements. These wired or wireless links can also be secure links and may be capable of communicating encrypted information. Transmission media used as links, for example, can be any suitable carrier for electrical signals, including coaxial cables, copper wire and fiber optics, and may take the form of acoustic or light waves, such as those generated during radio-wave and infra-red data communications.

Optionally, the systems and methods of this disclosure can be implemented in conjunction with a special purpose computer, a programmed microprocessor or microcontroller and peripheral integrated circuit element(s), an ASIC or other integrated circuit, a digital signal processor, a hard-wired electronic or logic circuit such as discrete element circuit, a programmable logic device or gate array such as PLD, PLA, FPGA, PAL, special purpose computer, any comparable means, or the like. In general, any device(s) or means capable of implementing the methodology illustrated herein can be used to implement the various aspects of this disclosure. Exemplary hardware that can be used for the disclosed embodiments, configurations and aspects includes computers, handheld devices, telephones (e.g., cellular, Internet enabled, digital, analog, hybrids, and others), and other hardware known in the art. Some of these devices include processors (e.g., a single or multiple microprocessors), memory, nonvolatile storage, input devices, and output devices. Furthermore, alternative software implementations including, but not limited to, distributed processing or component/object distributed processing, parallel processing, or virtual machine processing can also be constructed to implement the methods described herein.

In one embodiment, the disclosed methods may be readily implemented in conjunction with software using object or object-oriented software development environments that provide portable source code that can be used on a variety of computer or workstation platforms. Alternatively, the disclosed system may be implemented partially or fully in hardware using standard logic circuits or very-large-scale-integration (VLSI) design. Whether software or hardware is used to implement the systems in accordance with this disclosure is dependent on the speed and/or efficiency requirements of the system, the particular function, and the particular software or hardware systems or microprocessor or microcomputer systems being utilized.

In yet another embodiment, the disclosed methods may be partially implemented in software that can be stored on a storage medium, executed on programmed general-purpose computer with the cooperation of a controller and memory, a special purpose computer, a microprocessor, or the like. In these instances, the systems and methods of this disclosure can be implemented as program embedded on personal computer such as an applet, JAVA® or computer-generated imagery (CGI) script, as a resource residing on a server or computer workstation, as a routine embedded in a dedicated measurement system, system component, or the like. The system can also be implemented by physically incorporating the system and/or method into a software and/or hardware system.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

Examples of the processors as described herein may include, but are not limited to, at least one of Qualcomm® Snapdragon® 800 and 801, Qualcomm® Snapdragon® 610 and 615 with 4G LTE Integration and 64-bit computing, Apple® A7 processor with 64-bit architecture, Apple® M7 motion coprocessors, Samsung® Exynos® series, the Intel® Core™ family of processors, the Intel® Xeon® family of processors, the Intel® Atom™ family of processors, the Intel Itanium® family of processors, Intel® Core® i5-4670K and i7-4770K 22 nm Haswell, Intel® Core® i5-3570K 22 nm Ivy Bridge, the AMD® FX™ family of processors, AMD® FX-4300, FX-6300, and FX-8350 32 nm Vishera, AMD® Kaveri processors, Texas Instruments® Jacinto C6000™ automotive infotainment processors, Texas Instruments® OMAP™ automotive-grade mobile processors, ARM® Cortex™-M processors, ARM® Cortex-A and ARM926EJS™ processors, other industry-equivalent processors, and may perform computational functions using any known or future-developed standard, instruction set, libraries, and/or architecture.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

What is claimed is:

1. An inking assembly for a decorator configured to decorate an exterior surface of a metallic container, comprising:

an ink fountain to provide a supply of ink;

an ink roller to receive ink from the ink fountain;

a first drive element configured to rotate the ink roller at a predetermined first rate;

a metering roller with a first ink transfer position to receive ink from the ink roller and a second dwell position in which the metering roller does not receive ink from the ink roller, wherein in the first ink transfer position the metering roller is spaced a first distance from the ink roller, wherein the first distance is no greater than a thickness of ink on the ink roller, and wherein in the second dwell position the metering roller is spaced a second distance from the ink roller that is greater than the first distance;

an adjustment mechanism associated with the metering roller and which maintains a gap of at least approximately 0.002 inches between the metering roller and the ink roller when the metering roller is in the first ink transfer position, the adjustment mechanism configured to move the metering roller from the first ink transfer position to the second dwell position; and a transfer roller positioned downstream from the metering roller, wherein in the first ink transfer position the metering roller is in continuous contact with and transfers ink to the transfer roller, and wherein the adjustment mechanism is operable to move an axle of the metering roller away from an axle of the ink roller and an axle of the transfer roller to transfer the metering roller from the first ink transfer position to the second dwell position.

2. The inking assembly of claim 1, wherein the second distance is at least approximately 0.045 inches.

3. The inking assembly of claim 1, wherein the ink fountain further includes:

a plurality of ink blades; and an actuator associated with each of the plurality of ink blades, each actuator configured to move an associated ink blade relative to the ink roller to adjust an amount of ink received by the ink roller such that the thickness of ink on the ink roller is less than approximately 0.04 inches.

4. The inking assembly of claim 1, further comprising a control system operable to send a signal to the adjustment mechanism to move the metering roller closer to the ink roller to increase an amount of ink transferred to the transfer roller while the metering roller is in the first ink transfer position.

5. The inking assembly of claim 1, further comprising a second drive element configured to rotate the transfer roller, wherein the metering roller rotates at a second rate in response to a force received from the transfer roller when the metering roller is in the first ink transfer position, and wherein the second rate of rotation of the metering roller is not affected by the first rate of rotation of the ink roller.

6. The inking assembly of claim 1, further comprising a second drive element configured to rotate the transfer roller, wherein the metering roller rotates in response to a force received from the transfer roller when the metering roller is in the first ink transfer position, and wherein the second drive element is operable to cause the metering roller to rotate at a second rate that is at least equal to the first rate of rotation of the ink roller.

7. The inking assembly of claim 1, wherein during decorating, the adjustment mechanism is configured to keep the metering roller in the first ink transfer position in continuous contact with the transfer roller and while the metering roller does not contact the ink roller.

8. The inking assembly of claim 1, wherein the inking assembly further comprises a plurality of intermediate rollers positioned downstream from the transfer roller, wherein the plurality of intermediate rollers are configured to transfer ink from the transfer roller to a printing plate positioned on a plate cylinder of the decorator, and wherein the printing plate is operable to transfer ink to a transfer blanket positioned on a blanket cylinder of the decorator to decorate the exterior surface of the metallic container with the ink.

9. The inking assembly of claim 8, wherein the plurality of intermediate rollers include at least one of a second transfer roller, a third transfer roller, a first oscillator roller, a second oscillator roller, a form roller, and a rider roller, wherein at least one of the plurality of intermediate rollers is configured to contact the transfer roller, and wherein at least one of the plurality of intermediate rollers is configured to contact the printing plate.

10. The inking assembly of claim 9, wherein the axle of the metering roller is supported at one or more of a first end and a second end.

11. The inking assembly of claim 1, wherein the metering roller has a cylindrical body with an exterior surface comprises at least one of:

a rubber, a plastic, a ceramic, or a metal material;

grooves, knurls, or cross-hatching; or is substantially smooth.

12. The inking assembly of claim 1, wherein the adjustment mechanism includes one or more of a gear, a lever, and a shaft operably engaged to the axle of the metering roller, and wherein the adjustment mechanism and the axle of the metering roller are interconnected to a frame that is adapted to receive the ink roller and the transfer roller.

13. A method of decorating an exterior surface of a container with an inking assembly of a decorator, comprising:

providing an ink fountain with a supply of ink;

providing an ink roller to receive ink from the ink fountain;

providing a metering roller positioned downstream from the ink roller;

providing an adjustment mechanism configured to move the metering roller from a first ink transfer position to a second dwell position;

providing a transfer roller positioned downstream from the metering roller;

providing a plate cylinder with a printing plate positioned downstream from the transfer roller;

moving the metering roller to the first ink transfer position with the adjustment mechanism by moving an axle of the metering roller closer to both an axle of the transfer roller and to an axle of the ink roller such that the metering roller receives ink from the ink roller and transfers ink to the transfer roller, wherein in the first ink transfer position the metering roller does not contact the ink roller but is spaced from the ink roller by a first distance to form an ink gap, and wherein while in the first ink transfer position the adjustment mechanism keeps the metering roller in continuous contact with the transfer roller;

transferring ink from the transfer roller by intermediate rollers to the printing plate;

transferring ink from the printing plate to a transfer blanket affixed to a blanket wheel of the decorator;

transferring ink from the transfer blanket to the exterior surface of the container; and actuating the adjustment mechanism to transfer the metering roller from the first ink transfer position to the second dwell position by moving the axle of the metering roller away from the axle of the transfer roller and away from the axle of the ink roller.

14. The method of claim 13, wherein moving the metering roller to the first ink transfer position comprises actuating the adjustment mechanism such that the first distance between the metering roller and the ink roller is at least approximately 0.002 inches during the transfer of ink to the printing plates and wherein moving the metering roller from the first ink transfer position to the second dwell position interrupts the transfer of ink to the printing plate.

15. The method of claim 14, wherein in the second dwell position the metering roller is spaced from the ink roller by a second distance that is greater than the first distance, and wherein in the second dwell position the metering roller is spaced a predetermined third distance from the transfer roller such that the metering roller does not contact the transfer roller.

16. The method of claim 13, further comprising adjusting a size of the ink gap between the ink roller and the metering roller while the metering roller is in the first ink transfer position to alter an amount of ink transferred to the transfer roller, wherein adjusting the size of the ink gap comprises the adjustment mechanism moving the metering roller to between approximately 0.002 inches and approximately 0.05 inches from the ink roller.

17. The method of claim 13, further comprising increasing a rate of rotation of the ink roller to increase a volume of ink transferred to the printing plate, wherein decreasing the rate of rotation of the ink roller decreases the volume of ink transferred to the printing plate, and wherein the ink roller is driven at a first rate and the transfer roller is driven at a second rate which is distinct from the first rate when the metering roller is in the first ink transfer position.

18. The method of claim 13, further comprising:

actuating a first drive element such that the ink roller rotates at a first rate; and actuating a second drive element such that in the first ink transfer position the metering roller rotates at a second rate that is at least equal to the first rate of rotation of the ink roller.

* * * * *